US012607090B1

(12) United States Patent
Laplane et al.

(10) Patent No.: US 12,607,090 B1
(45) Date of Patent: Apr. 21, 2026

(54) DOWNHOLE SEALING MECHANISMS AND METHODS OF USE THEREOF

(71) Applicant: Schlumberger Technology Corporation, Sugar Land, TX (US)

(72) Inventors: Clement Laplane, Houston, TX (US); Sai Aung Thu Win Tin, Kuala Lumpur (MY); Hai Liu, Paris (FR); Alexander Rudnik, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 19/248,872

(22) Filed: Jun. 25, 2025

(51) Int. Cl.
*E21B 33/134* (2006.01)

(52) U.S. Cl.
CPC ..... *E21B 33/134* (2013.01)

(58) Field of Classification Search
CPC ..... E21B 33/134
See application file for complete search history.

(56) References Cited

U.S. PATENT DOCUMENTS 11,473,397 B2 * 10/2022 Egbe ..... E21B 21/003
2020/0032614 A1 * 1/2020 Usher ..... E21B 33/134

FOREIGN PATENT DOCUMENTS

RU 2386779 C1 * 4/2010
WO WO-2020076163 A1 * 4/2020 ..... E21B 47/005

* cited by examiner

*Primary Examiner* — Theodore N Yao
(74) *Attorney, Agent, or Firm* — Jeffrey D. Frantz

(57) ABSTRACT

A method and system for sealing a perforated tubular is provided. The method includes disposing a meltable alloy in a wellbore including a perforated tubular disposed therein at a desired seal location, the wellbore and the perforated tubular defining an annulus and applying a heating gradient to the meltable alloy such that the meltable alloy melts and resolidifies before the meltable alloy seals an entire cross-section of the annulus.

10 Claims, 20 Drawing Sheets

DOWNHOLE SEALING MECHANISMS AND METHODS OF USE THEREOF

BACKGROUND

The present disclosure generally relates to the oil and gas industry. More specifically, the present disclosure relates to sealing wellbores and wellbore components. Wells are utilized to produce hydrocarbons from a formation and may include structures within the wellbore such as perforated tubulars. An annulus is formed between the screen and the formation (or casing or wellbore wall). During production of hydrocarbons, hydrocarbon-containing fluid flows from the formation, into the annulus, is filtered through the screens, and flows up through the internal bore of the screens and other tubular components to the surface. Occasionally, the well system can fail or experience damage, necessitating downhole sealing mechanisms. As an example, damage can occur to the screen impacting the filtering capabilities of the screens. As another example, water may find its way from the formation or an aquifer and into the annulus thus leading to undesirable water production rather than hydrocarbon production.

Accordingly, there is a continuous need for improved systems and methods for downhole scaling.

SUMMARY

Aspects of the present disclosure provide a method and system for sealing a perforated tubular. The method includes disposing a meltable alloy in a wellbore including a perforated tubular disposed therein at a desired seal location, the wellbore and the perforated tubular defining an annulus and applying a heating gradient to the meltable alloy such that the meltable alloy melts and resolidifies before the meltable alloy seals an entire cross-section of the annulus.

Aspects of the present disclosure provide a method of sealing an annulus of a wellbore. The method includes lowering a heater into a tubular to a desired isolation location, the tubular is disposed within a wellbore defining an annulus therebetween and includes a meltable alloy sleeve disposed about the tubular at the desired isolation location and applying a heat gradient to the meltable alloy sleeve such that the meltable alloy sleeve melts to fill the annulus at the desired isolation location and resolidifies to seal the annulus at the desired isolation location.

Aspects of the present disclosure provide a method of sealing a portion of a wellbore. The method includes isolating a section of a wellbore from a remainder of the wellbore using a first isolation body disposed above the section of the wellbore and a second isolation body disposed below the section of the wellbore, wherein a perforated tubular is disposed within the wellbore defining an annulus between the perforated tubular and the wellbore, lowering a bottom hole assembly (BHA) through a bore of the perforated tubular, milling a portion of the first isolation body within the bore of the perforated tubular with the BHA, sealing a portion of the BHA against the milled portion of the first isolation body, flowing a sealant from the BHA into the annulus of the isolated section of the wellbore to seal the annulus and/or the formation, and milling a portion of the second isolation body within the bore of the perforated tubular with the BHA, then open the well to produce from the remainder of the wellbore.

BRIEF DESCRIPTION OF DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments. It is emphasized that, in accordance with the standard practice in the industry, various features are not drawn to scale. In fact, the dimensions of the various features may be arbitrarily increased or reduced for clarity of discussion.

DETAILED DESCRIPTION

Illustrative examples of the subject matter claimed below will now be disclosed. In the interest of clarity, not all features of an actual implementation are described in this specification. It will be appreciated which in the development of any such actual implementation, numerous implementation-specific decisions may be made to achieve the developers' specific goals, such as compliance with system-related and business-related constraints, which will vary from one implementation to another. Moreover, it will be appreciated which such a development effort, even if complex and time-consuming, would be a routine undertaking for those of ordinary skill in the art having the benefit of this disclosure.

Further, as used herein, the article "a" is intended to have its ordinary meaning in the patent arts, namely "one or more." For the sake of brevity, all similar components have been given similar reference numbers with the same last two digits and a full description of such similar components may not be repeated herein.

Aspects of the present disclosure provide mechanisms for sealing a wellbore and methods of use thereof. In one or more embodiments, sealing the wellbore includes utilizing a heating gradient to selectively melt and resolidify a meltable alloy disposed in the wellbore to seal at least a portion of the wellbore. In one or more embodiments, the portion is a seal location in a perforated tubular (e.g., a damaged portion of the perforated tubular). In one or more embodiments, the portion is the annulus of the wellbore. In one or more embodiments, the sealing the wellbore includes isolating a portion of the wellbore, utilizing a bottom hole assembly (BHA) to drill through a first isolation body defining the top of the isolated zone of the wellbore, filling the isolated zone with a sealant flowed from the BHA while the BHA seals against the first isolation body such that the sealant only seals within the isolated zone, and utilizing the BHA to drill through a second isolation body defining the isolation zone. Accordingly, in such embodiments, the sealing the wellbore includes utilizing the BHA to seal a portion of the wellbore and, in some cases, a portion of the formation.

Figure 1:
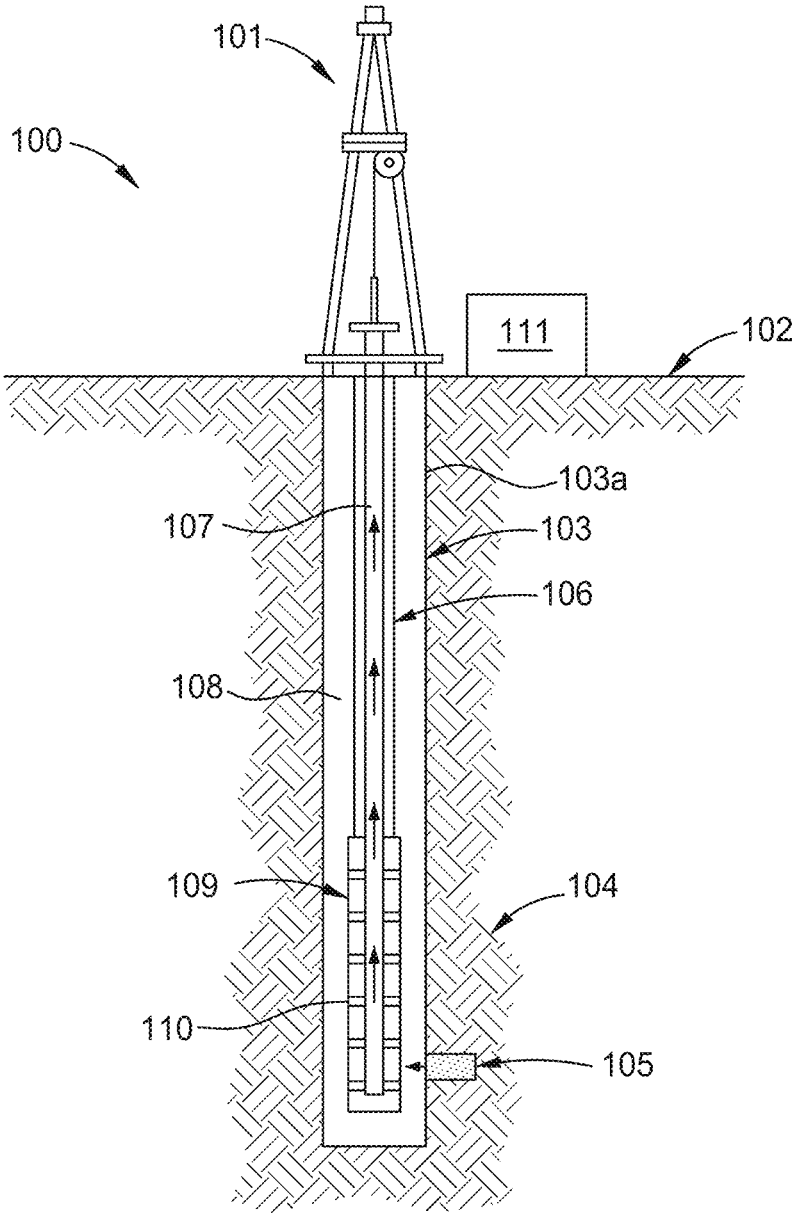
FIG. 1 illustrates a schematic view of a wellsite, according to one or more embodiments.

FIG. 1 illustrates a schematic view of a wellsite 100, according to one or more embodiments. The wellsite 100 includes surface equipment 101 disposed on a surface 102 above a wellbore 103 formed in a geological formation 104. The geological formation 104 may contain reservoir fluids 105 (e.g., hydrocarbons). Accordingly, the wellbore 103 may be utilized to extract (i.e., "produce") the reservoir fluids 105 from within the geological formation 104.

The wellbore 103 includes a tubular string 106 disposed within the wellbore 103. The tubular string 106 includes an inner bore 107 through which the reservoir fluid 105 is produced (i.e. pumped uphole to the surface). An annulus 108 is formed between the tubular string 106 and the wellbore wall 103*a*. In one or more embodiments, the wellbore wall 103*a* is uncased (i.e., does not include a cement casing on the wall). In one or more embodiments, the wellbore wall 103*a* is cased (i.e., includes a cement casing on the wall).

The tubular string 106 may include a string of interconnected tubulars. As illustrated, the tubular string 106 includes a perforated tubular 109. The perforated tubular 109 can include, but is not limited to, perforated tubing, a slotted liner, well integrity puncture pipe eroded from sand production, and sand screens (e.g., wire wrap, meshrite, and other sand screens known to a person of ordinary skill). The perforated tubular 109 includes perforations 110 through which reservoir fluid 105 flows into the inner bore 107 to be produced. The perforations 110 are designed to filter the reservoir fluids 105. In one or more embodiments, filtering the reservoir fluids 105 includes filtering solids, such as sediment, from the reservoir fluids 105. The solids may be filtered from the reservoir fluids 105 to prevent damage to the extraction system and may be initial stage in isolating hydrocarbons and/or desired fluids from the remainder of the reservoir fluid 105.

According to one mode of operation, reservoir fluids 105 flow into the annulus 108, into the inner bore 107 through perforations 110 in the perforated tubular 109 which filter the reservoir fluids 105, and the filtered reservoir fluids 105 are produced (i.e. flowed uphole to the surface 102) via the inner bore 107.

In one or more embodiments, the surface equipment 101 includes a processing system 111. The processing system 111 may include a controller. The controller may include a programmable central processing unit (CPU) which is operable with a memory (e.g., non-transitory computer readable medium and/or non-volatile memory) and support circuits. The support circuits are coupled to the CPU and includes cache, clock circuits, input/output subsystems, power supplies, and the like, and combinations thereof coupled to the various components of the processing system 111, to facilitate performing one or more operations of methods 200, 600, 900. For example, in one or more embodiments the CPU is one of any form of general purpose computer processor used in an industrial setting, such as a programmable logic controller (PLC). The memory, coupled to the CPU, is non-transitory and is one or more of readily available memory such as random access memory (RAM), read only memory (ROM), floppy disk drive, hard disk, or any other form of digital storage, local or remote.

Herein, the memory is in the form of a computer-readable storage media containing instructions (e.g., non-volatile memory), that when executed by the CPU, facilitates the operations of the wellsite 100. The instructions in the memory are in the form of a program product such as a program that implements the methods of the present disclosure (e.g., middleware application, equipment software application, etc.). The program code may conform to any one of a number of different programming languages. In one or more embodiments, the disclosure may be implemented as a program product stored on computer-readable storage media for use with a computer system. The program(s) of the program product define functions of the embodiments (including the methods and operations described herein).

Illustrative computer-readable storage media include, but are not limited to: (i) non-writable storage media (e.g., read-only memory devices within a computer such as CD-ROM disks readable by a CD-ROM drive, flash memory, ROM chips or any type of solid-state non-volatile semiconductor memory) on which information is permanently stored; and (ii) writable storage media (e.g., floppy disks within a diskette drive or hard-disk drive or any type of solid-state random-access semiconductor memory) on which alterable information is stored. Such computer-readable storage media, when carrying computer-readable instructions that direct the functions of the methods described herein, are embodiments of the present disclosure.

The various methods (such as methods 200, 600, 900) and operations disclosed herein may generally be implemented under the control of the CPU of the processing system 111 by the CPU executing computer instruction code stored in the memory as, e.g., a software routine. When the computer instruction code is executed by the CPU, the CPU conducts operations in accordance with the various methods and operations described herein. In one or more embodiments, the memory (a non-transitory computer readable medium) includes instructions stored therein that, when executed, cause the method (such as the methods 200, 600, 900) described herein to be conducted. The operations described herein can be stored in the memory in the form of computer readable logic.

While illustrated as being disposed on the surface 102, in one or more embodiments, the processing system 111 may be disposed downhole (i.e., in the wellbore 103) as part of a tool string.

Figure 2:
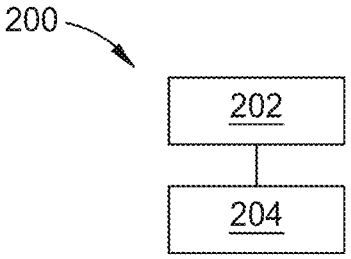
FIG. 2 illustrates a method for sealing a perforated tubular, according to one or more embodiments.

FIG. 2 illustrates a method 200 for sealing a perforated tubular, according to one or more embodiments. FIGS. 3A-3D schematically illustrate an embodiment of the method 200 of FIG. 2.

Figure 3A:
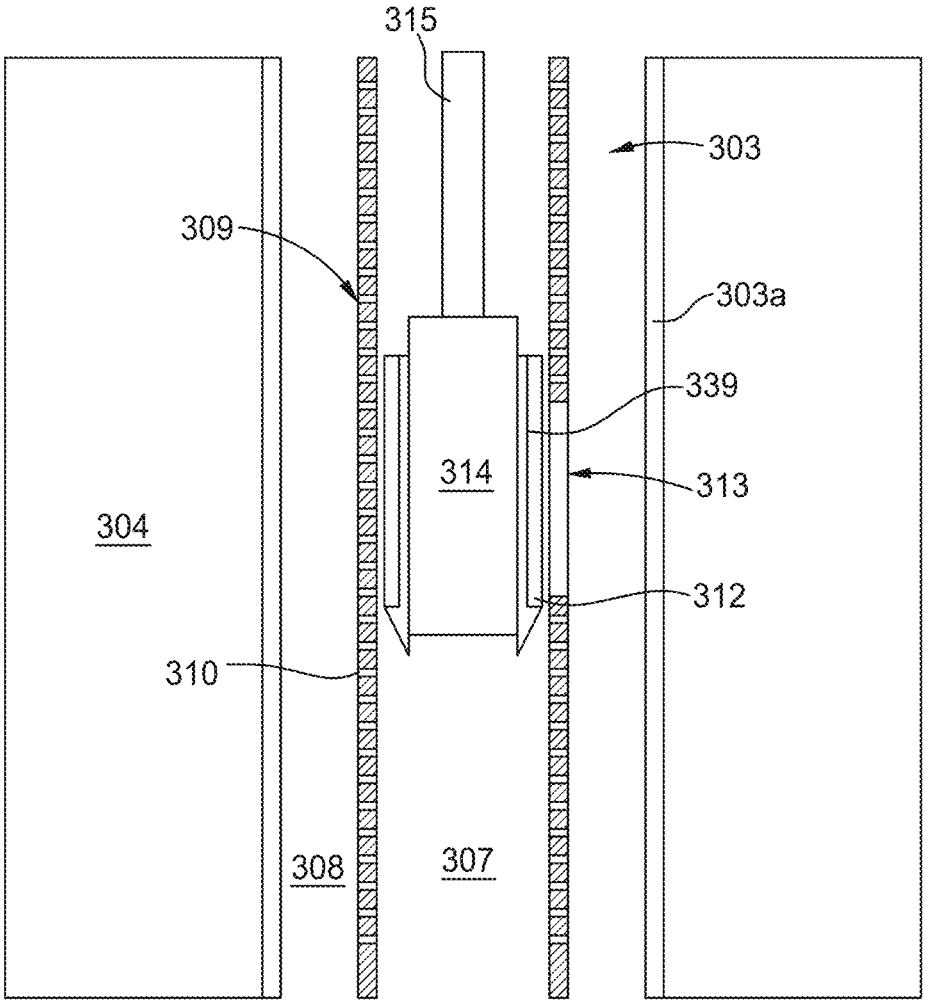
FIGS. 3A-3D schematically illustrate sealing a perforated tubular according to the method of FIG. 2, according to one or more embodiments.

At operation 202, and as illustrated in FIG. 3A, a meltable alloy 312 is disposed in the wellbore 303 including the perforated tubular 309 at a desired seal location 313. In one or more embodiments, the meltable alloy 312 includes Bismuth. In one or more embodiments, the desired seal location 313 is a damaged portion of the perforated tubular 309. For example, the damaged portion may be a hole and/or a perforation 310 that has been enlarged, has a damaged mesh liner, or has otherwise been damaged to affect its filtering capabilities. In such embodiments, the damaged portion may be sealed to improve the filtering properties of the perforated tubular 309.

In one or more embodiments, such as the one illustrated in FIGS. 3A-3D, the meltable alloy 312 is transported downhole by a tool 314 coupled to a tool string 315. In one or more embodiments, the tool string 315 includes a wireline, coiled tubing, or a string of tools axially coupled to one another. In one or more embodiments, the meltable alloy 312 is releasably coupled to the tool 314 so that the tool 314 may release the meltable alloy 312 at the desired seal location. In one or more embodiments, such as the embodiment illustrated in FIGS. 3A-3B, the meltable alloy 312 is rigidly coupled to the tool 314. In such embodiments, the meltable alloy 312 may be a sleeve attached to an outer surface of the tool 314. Still, in one or more embodiments, the meltable alloy 312 is integral to the tool 314 or is the entirety of the tool 314 (i.e., the meltable alloy 312 is bulk meltable alloy coupled to the tool string 315).

In one or more embodiments, such as the illustrated embodiment, the meltable alloy 312 is a sleeve disposed on an outer surface of a mandrel 339 releasably coupled to the tool 314.

In one or more embodiments, such as the one illustrated in FIGS. 3A-3D, the tool 314 may be a heater 314. Thus, according to one mode of operation, the meltable alloy 312 is a sleeve disposed around and coupled to an outer surface of a heater 314 (or a mandrel 339 disposed about the heater 314) that is lowered into the inner bore 307 of the perforated tubular 309 to a desired seal location 313 (e.g., a damaged portion of the perforated tubular 309).

Figure 3B:
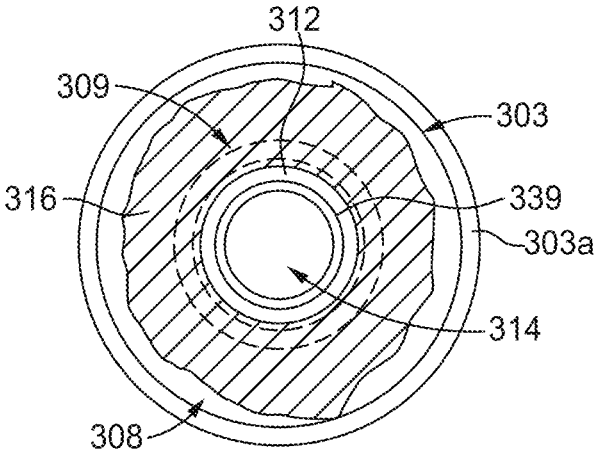
Figure 3C:
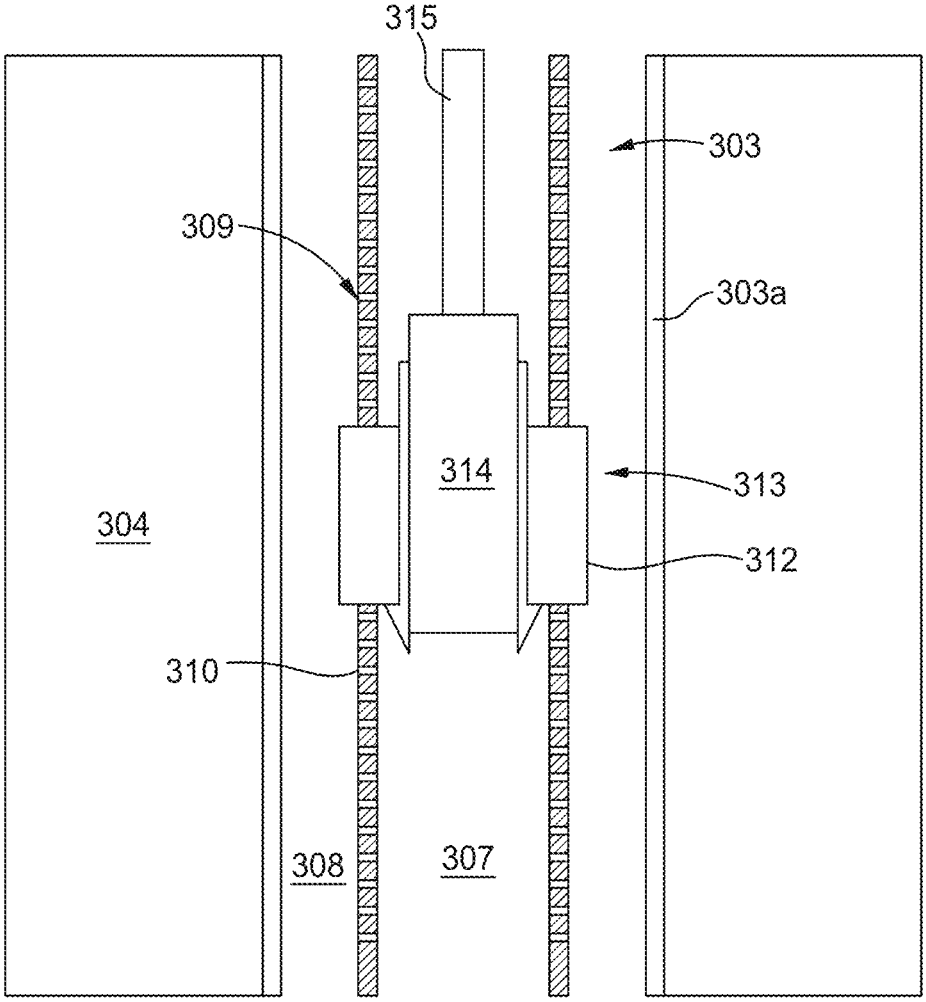

At operation 204, and as illustrated in FIGS. 3B-3C, a heating gradient 316 is applied to the meltable alloy 312 such that the meltable alloy 312 melts and resolidifies before the meltable alloy 312 seals the entire cross-section of the annulus 308. In one or more embodiments, such as the illustrated embodiment, the heat gradient 316 is applied by the same tool 314 (e.g., heater 314) used to dispose the meltable alloy 312 in the wellbore 303 at the desired location 313.

In one or more embodiments, such as the one illustrated in FIG. 3B, the heat gradient 316 applied by the tool 314 varies radially.

The heat gradient 316 applied by the tool 314 may vary radially to control melting of the meltable alloy 312. As a non-limiting example, the radial distance of the desired seal location 313 from the longitudinal axis may be known. Accordingly, the heat gradient 316 may be such that the tool 314 applies a heat to radial distance from the longitudinal axis of the tool 314 to allow the meltable alloy 312 to melt and flow to the desired seal location 313. However, the heat gradient 316 may be such that the tool 314 applies no heat, or less heat past the radial distance of the desired seal location 313. Accordingly, the heat gradient 316 can be used to precisely melt the meltable alloy 312 to seal the desired seal location 313 without melting the meltable alloy 312 to completely fill the annulus 308. As a non-limiting example, the heat gradient 316 may have a maximum heat at the outer surface of the tool 314 and a minimum heat (or zero heat) at a radial location corresponding to the outer surface of the perforated tubular 309. As another non-limiting example, the heat gradient 316 may have a maximum heat at the outer surface of the tool 314 and a minimum heat (or zero heat) at a radial location corresponding to just past the perforated tubular 309.

Further, the heat gradient 316 may control resolidification of the meltable alloy 312 by controlling the heat applied by the tool 314 radially and by taking into account the melting properties of the meltable alloy 312. As a non-limiting example, the heat gradient 316 may be such that the heat is only applied a certain radial distance. For example, as illustrated, the heat gradient 316 may be such that heat is only applied as far as between the outer diameter of the perforated tubular 309 and the inner diameter of the wellbore wall 303*a* (e.g., the inner diameter of the casing 303*a*). Thus, by controlling the heat applied by the tool 314 radially and by taking into account the melting properties of the meltable alloy 312, the heat gradient 316 can be designed such that the meltable alloy 312 resolidifies before sealing the annulus 308 and/or before the meltable alloy 312 melts and contacts the wellbore wall 303*a* (e.g., the casing 303*a*).

Figure 3D:
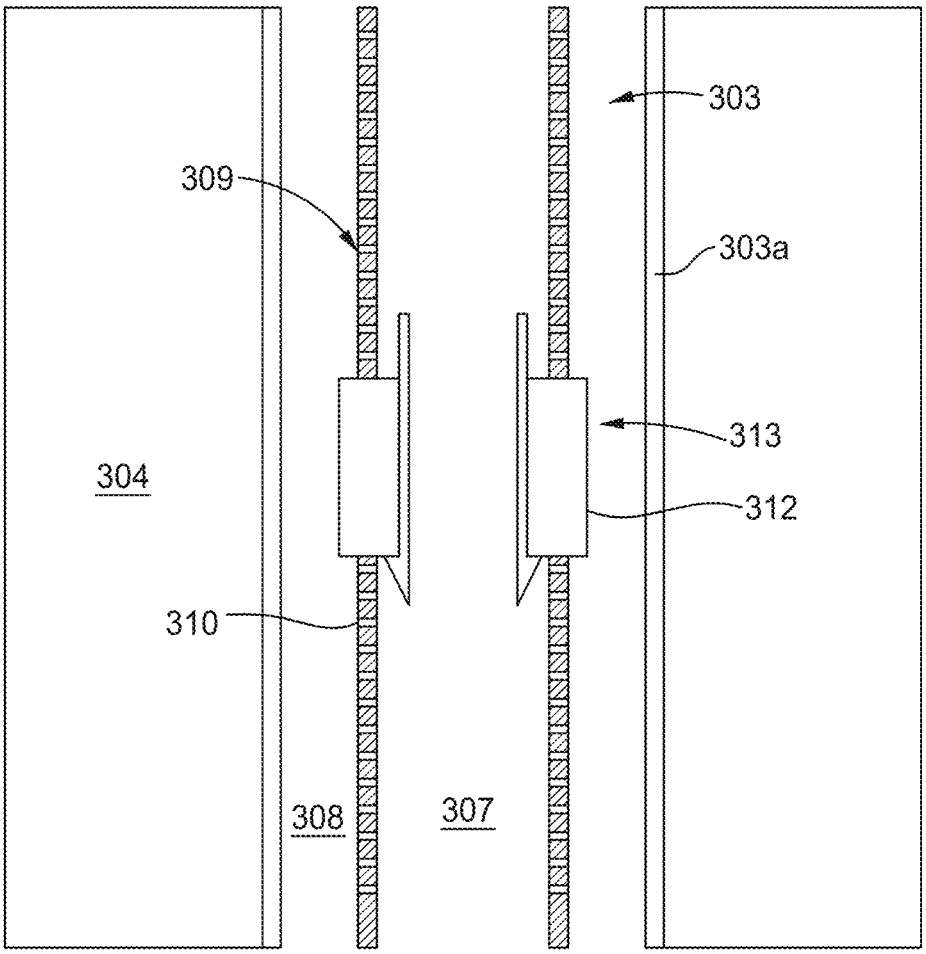

Subsequently, the tool 314 can be removed from the perforated tubular 309 (and the wellbore 303) leaving the desired seal location 313 sealed with the inner bore 307 of the perforated tubular 309 and the annulus 308 unsealed, as shown in FIG. 3D. In one or more embodiments, the tool 314, excess meltable alloy 312, and any other component blocking the inner bore 307 of the perforated tubular can be removed (e.g., by milling). In one or more embodiments including the mandrel 339, such as the illustrated embodiment, the mandrel 339 may remain in place in the perforated tubular 309.

Thus, the perforated tubular 309 and the remainder of the system may be used to produce reservoir fluids through the annulus 308, into the inner bore 307 of the perforated tubular 309 through the perforations 310, and up to the surface through the inner bore 307.

Figure 4A:
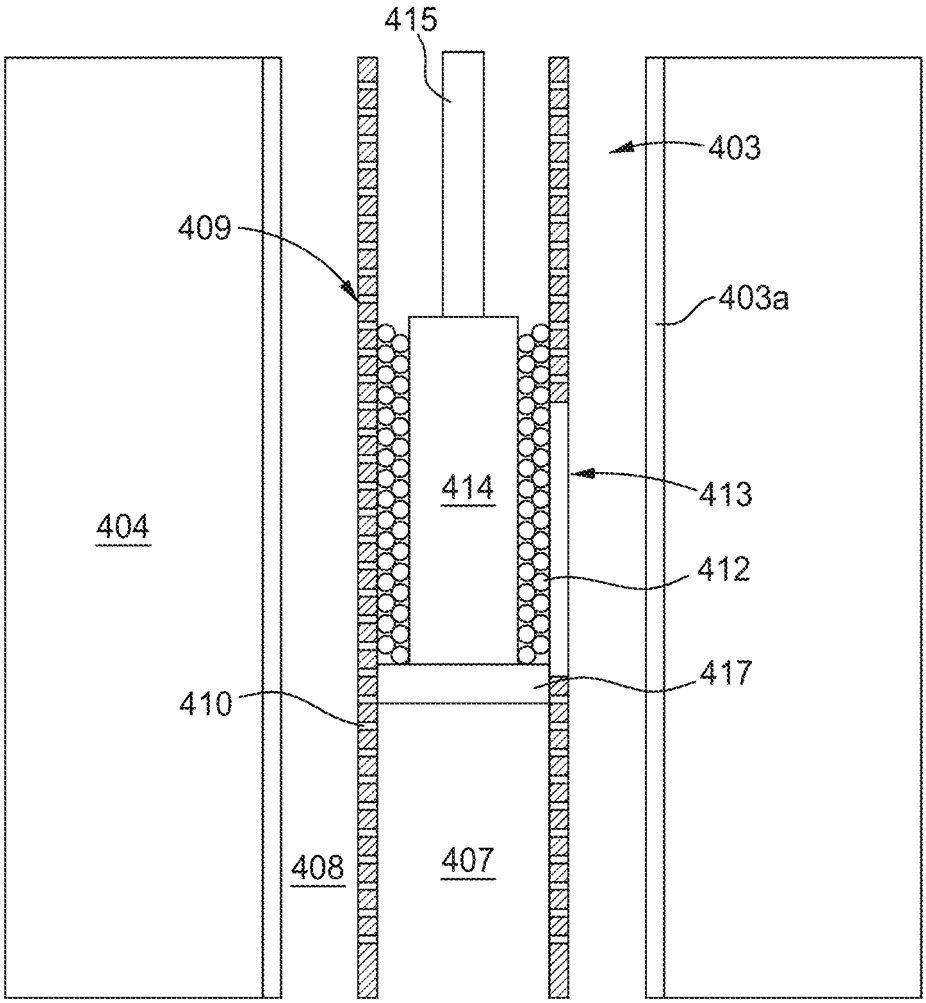
FIGS. 4A-4C schematically illustrate sealing a perforated tubular according to the method of FIG. 2, according to one or more embodiments.
Figure 4B:
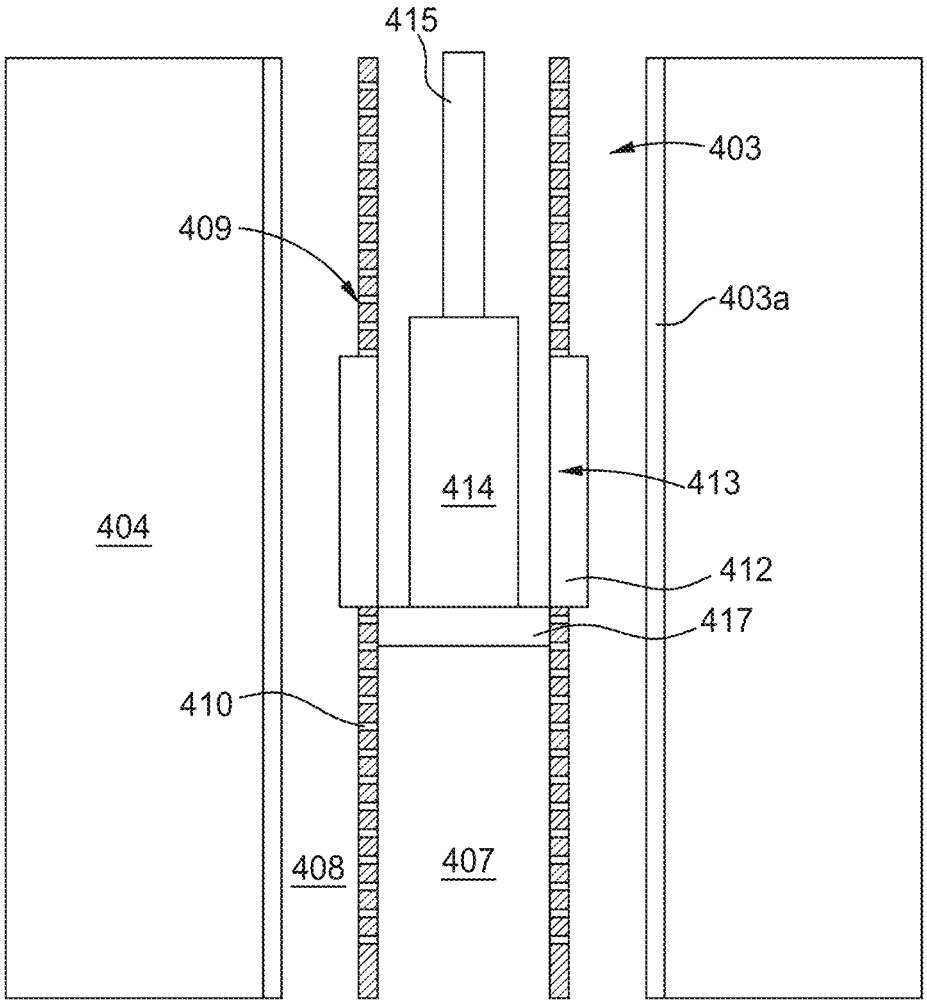
Figure 4C:
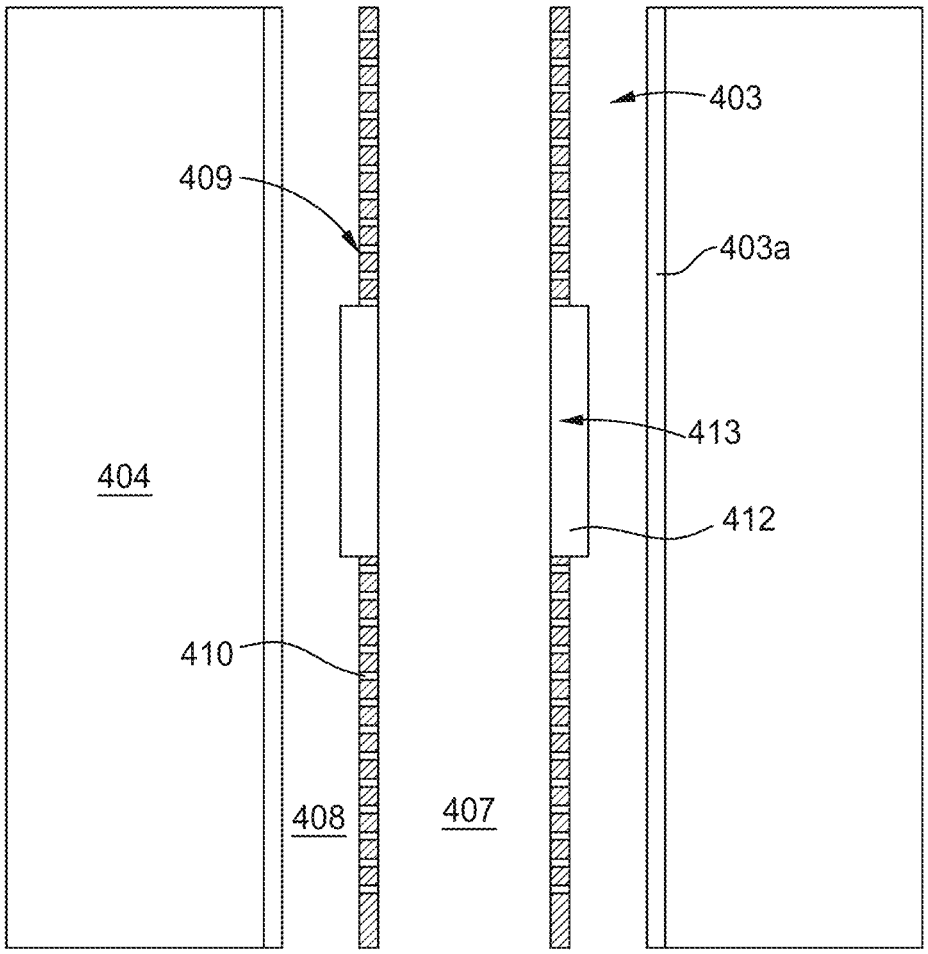

FIGS. 4A-4C schematically illustrate another embodiment of method 200 of FIG. 2. The operation according to FIGS. 4A-4C is similar to that described and shown in FIGS. 3A-3D. Accordingly, a description of like components and operations may not be repeated herein. Like reference numbers of similar components have been given the same last two digits.

As previously described, at operation 202, and as illustrated in FIG. 4A, a meltable alloy 412 is disposed in the wellbore 403 including the perforated tubular 409 at a desired seal location 413. Unlike the embodiment illustrated in FIGS. 3A-3D the meltable alloy 412 is disposed in the wellbore 403 independently of tool 414. In one or more embodiments, the meltable alloy 412 may be flowed to the desired seal location 413. In one or more embodiments, such as the illustrated embodiment, the meltable alloy 412 is pumped to the desired seal location 413 in solid form. The meltable alloy 412 may be in the form of a plug, large solids, or the meltable alloy 412 may be in the form of pellets that are pumpable, flowable, droppable, or may otherwise be transportable to the desired seal location 413 as illustrated. In one or more embodiments, the meltable alloy 412 is transported via the wellbore 403. As another non-limiting example, and as illustrated, the meltable alloy may be transported via an annulus 408 created between the tool 414 and the perforated tubular 409.

In embodiments where the meltable alloy 412 is disposed in the wellbore 403 independently of the tool 414, the perforated tubular 409, the tool 414, and/or the wellbore 403 may include a mechanism 417 for retaining the unmelted meltable alloy 412 in the desired seal location before the meltable alloy 412 is melted and resolidified in place. In one or more embodiments, such as the illustrated embodiments, that mechanism 417 may be in the form of a packer (e.g., a mechanical or chemical packer) or a feature (e.g., a ledge, shoulder, or pocket) of the tool 414. In one or more embodiments, the mechanism 417 may include a mandrel releasably attached to the tool 414 and may operate similarly to mandrel 339 of FIGS. 3A-3D). In embodiments including the mechanism 417, the mechanism 417 is positioned to retain the meltable alloy 412 in place until it is melted. In one or more embodiments, that mechanism may be in the form of a feature on the perforated tubular (not shown) such as a ledge, shoulder, or pocket. In one or more embodiments, that mechanism may be an independent tool of the tool 414 and all other components of the system. In one or more embodiments, the mechanism 417 may be permanently or temporarily installed into the perforated tubular 409. For example, the mechanism may include a packer, plug, sand or other sealing method or device usable within the perforated tubular 409 (e.g., by dropping or running in) that can retain the meltable alloy 412 in place. In such embodiments, the mechanism 417 may be designed to remain in the perforated tubular 409 (such as for when production of the wellbore 403 below the tubular is to be temporarily or permanently ceased). In one or more embodiments, the meltable alloy 412 itself includes a retaining mechanism 417. For example, the meltable alloy 412 may be shaped (e.g., like a plug or a ball) and that shape in combination with the feature of the perforated tubular 409 or tool 414 may retain the meltable alloy 412 in place.

After the meltable alloy 412 is disposed at the desired seal location 413, operation 204 and the remainder of the operations and components described with respect to FIGS. 2-3D are similarly applicable to the embodiment illustrated in FIGS. 4A-4C. However, in one or more embodiments, the mechanism 417 may be removed from the wellbore 403 after the meltable alloy 412 is resolidified. In one or more embodiments the mechanism 417 may remain in the perforated tubular 409 to isolate the entirety of the cross section of the wellbore 403 below the solidified meltable alloy 412.

Figure 5:
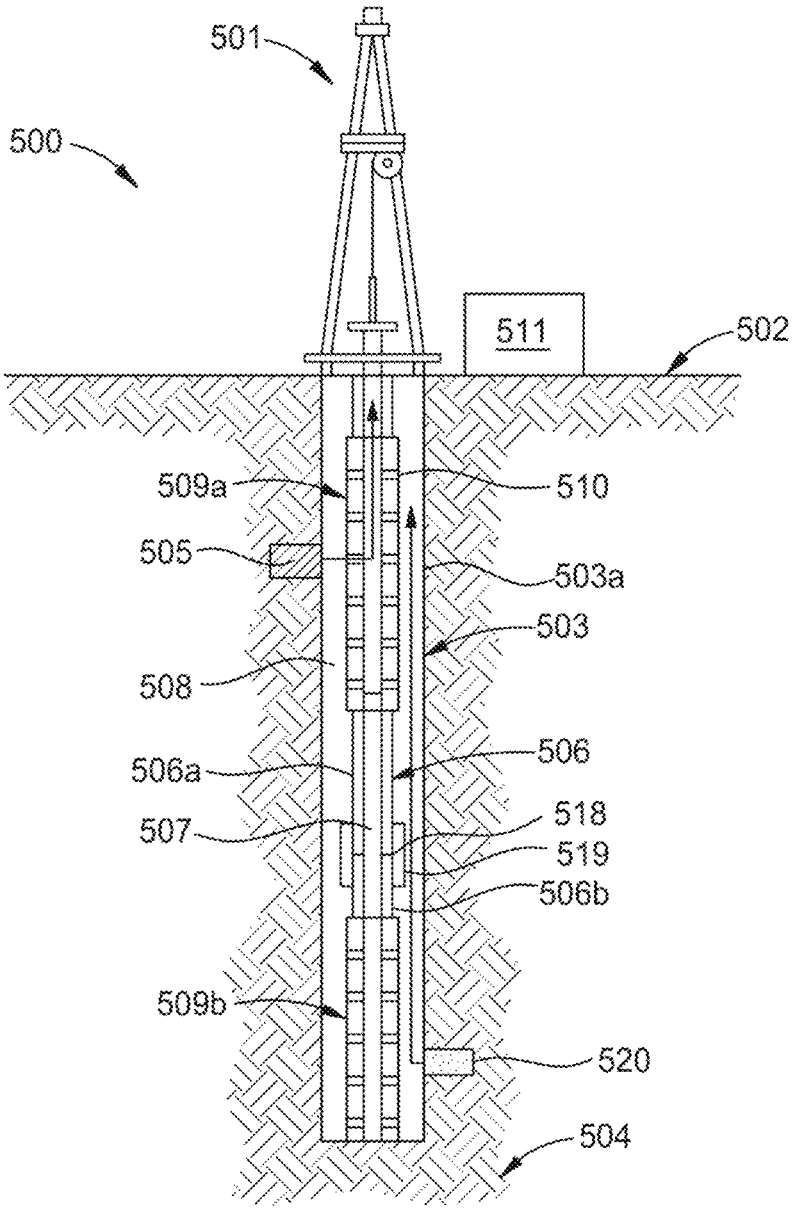
FIG. 5 illustrates a schematic view of another wellsite, according to one or more embodiments.

FIG. 5 illustrates a schematic view of another wellsite 500, according to one or more embodiments. Wellsite 500 and wellsite 100 may be at least partially similar in components and operation. Accordingly, a description of like components and operations may not be repeated herein. Like reference numbers of similar components have been given the same last two digits.

The wellsite 500 includes a first tubular 506*a* and a second tubular 506*b* as a part of the tubular string 506. The first tubular 506*a* and the second tubular 506*b* are axially connected by a joint coupling 518 to create a continuous bore 507 for producing reservoir fluids 505. The joint coupling 518 may be a threaded connection between the first tubular 506*a* and the second tubular 506*b*. In one or more embodiments, the joint coupling 518 may be a separate tubular, sleeve, clamp, or other component coupling the first tubular 506*a* to the second tubular 506*b*. In one or more embodiments, the tubular string 506 includes sleeves 519 disposed about the tubular string 506. In one or more embodiments, such as the one illustrated, a sleeve 519 may be provided about the joint coupling 518. In one or more embodiments, the sleeve 519 may be coupled to and/or integral to the joint coupling 518 and may be installed to the tubular string 506 as the joint coupling 518 is installed (e.g., as the tubular string 506 is being assembled into the wellbore 503).

According to one mode of operation, and as previously described, the reservoir fluids 505 flow from the geological formation 504 into the annulus 508, through perforations 510 in one or more perforated tubulars 509*a*, 509*b*, and into the continuous bore 507 of the tubular string 506 to be produced to the surface 502.

Occasionally water 520 is undesirably produced at the wellsite 500. As illustrated, water 520 may flow into the annulus 508 (and/or one or more of the perforated tubulars 509*a*, 509*b*) and, thus, may be produced similar to how the reservoir fluids 505 are produced, as described above. In some embodiments, the water 520 flows from the geological formation 504 or some other underground aquifer. Water production 520 may create hydrostatic pressure in production tubing, which subjects hydrocarbon producing zones to an unhealthy back pressure. Unhealthy backpressure may prevent reservoir fluids 505 from being produced.

Figure 6:
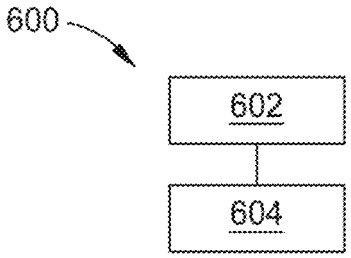
FIG. 6 illustrates a method for sealing an annulus of a wellbore, according to one or more embodiments.

FIG. 6 illustrates a method 600 for sealing an annulus of a wellbore, according to one or more embodiments. As a non-limiting example, the method 600 may be used when it is desirable to isolate a portion of the wellbore (such as when there is undesirable water production). FIGS. 7A-7D schematically illustrate sealing an annulus of a wellbore according to the method of FIG. 6, according to one or more embodiments. Method 600 may be at least partially similar in components and operation to method 200. Accordingly, a description of like components and operations may not be repeated herein. Like reference numbers of similar components have been given the same last two digits.

Figure 7A:
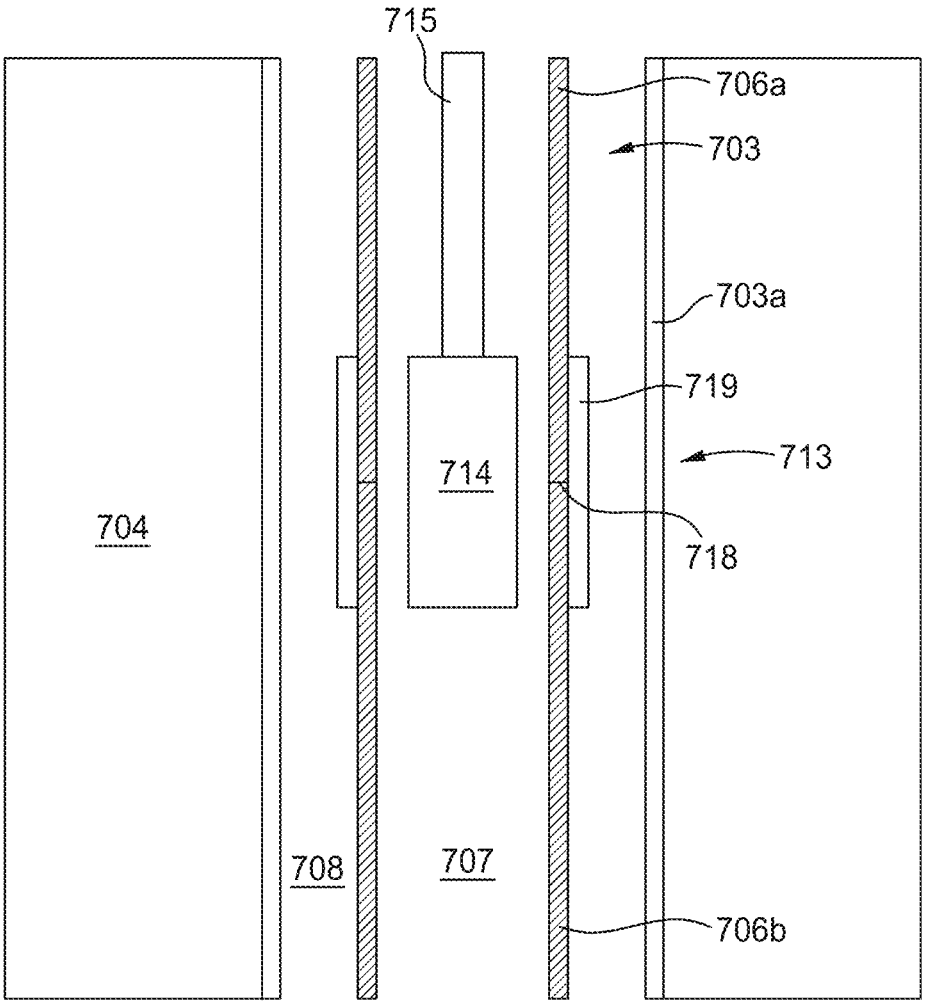
FIGS. 7A-7D schematically illustrate sealing an annulus of a wellbore according to the method of FIG. 6, according to one or more embodiments.

At operation 602, and as illustrated in FIG. 7A, a tool 714 (e.g., a heater) is lowered into a tubular string 706 to a desired seal location 713. The desired seal location 713 includes a meltable alloy sleeve 719 disposed about the tubular string 706 at the desired seal location 713. In one or more embodiments, the meltable alloy sleeve 719 includes Bismuth. In one or more embodiments, the meltable alloy sleeve 719 is disposed about a joint coupling 718 between a first tubular 706*a* and a second tubular 706*b*. In one or more embodiments, the meltable alloy sleeve 719 is installed as the tubular string 706 is assembled (i.e., installed) into the wellbore 703 and remains in the wellbore 703 until there is a reason for sealing the annulus 708 according to method 600.

Figure 7B:
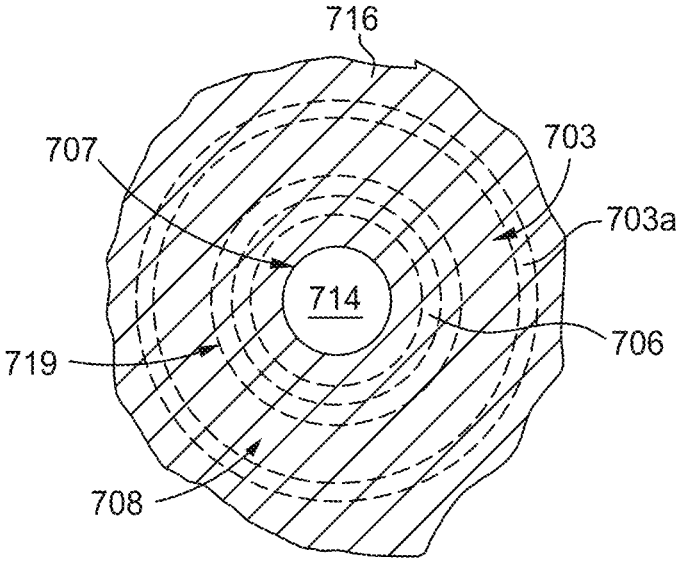
Figure 7C:
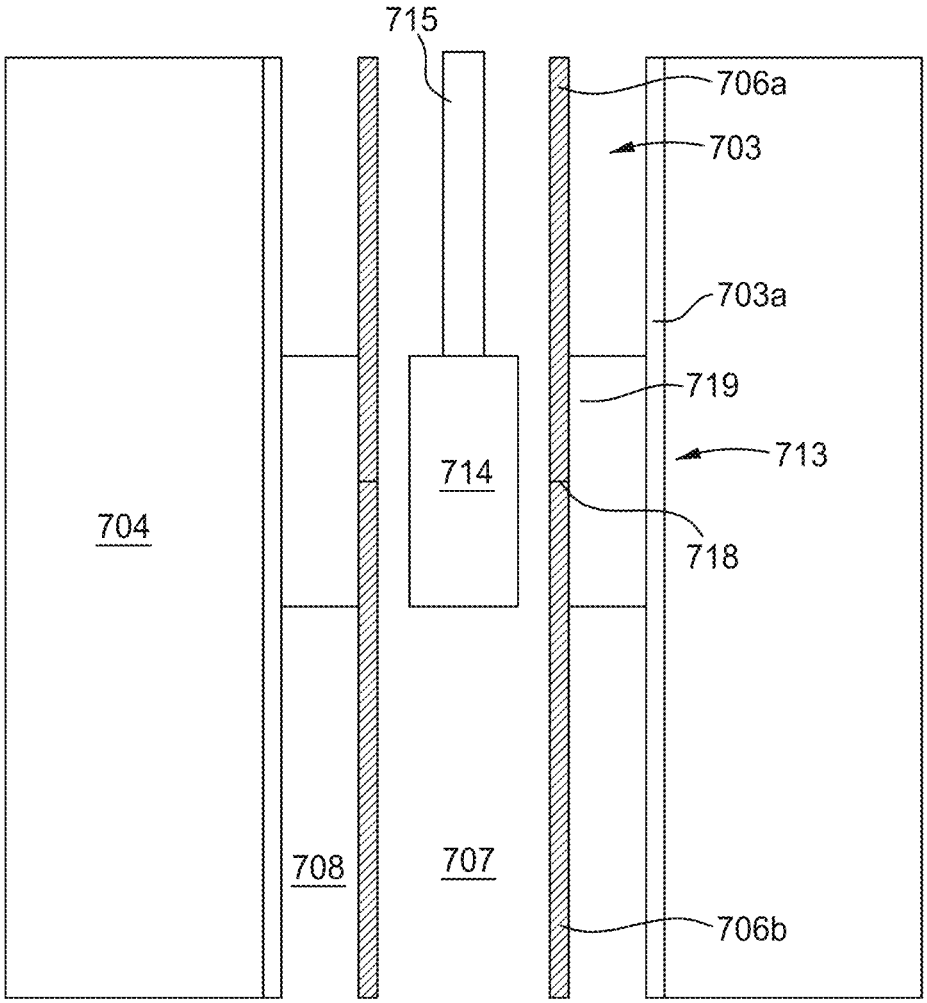

At operation 604, and as illustrated in FIGS. 7B-7C, a heating gradient 716 is applied to the meltable alloy sleeve 719. The heat gradient 716 causes the meltable alloy sleeve 719 to melt and fill the annulus 708 at the desired seal location 713. The melted alloy then solidifies to seal the annulus 708 at the desired seal location 713. In one or more embodiments, such as the one illustrated in FIG. 7B, the heat gradient 716 is applied by the tool 714. The heating gradient 716 may vary radially to control melting and resolidification of the meltable alloy sleeve 719, as described above in method 200 and shown in FIG. 3B. In one or more embodiments, the melting and resolidification may be controlled to partially or fully fill the cross section of the annulus 708 at the desired seal location 713. For instance, the gradient 716 may apply heat to, or past, the wellbore wall 703*a* to ensure complete fill of the annulus 708. In one or more embodiments, the heating gradient 716 may be utilized to control melting and resolidification to ensure that only the cross-section of the annulus 708 at the desired seal location 713 is sealed thus preventing dripping or overfilling the annulus 708 with melted alloy.

Subsequently, the tool 714 can be removed from the perforated tubular 709 (and the wellbore 703) leaving the annulus at the desired seal location 713 sealed. Accordingly, the portion of the annulus 708 below the desired seal location 713 is isolated from the portion of the annulus 708 above the desired seal location 713. In one or more embodiments, the above described method 600 may be repeated multiple times or at multiple locations along a tubular string 706 (e.g., at various joints of tubulars along the tubular string 706 or elsewhere) to isolate various zones of the annulus 708. According to one or more embodiments, there may be a first desired seal location 713 including a first meltable alloy sleeve 719 and a second desired seal location 713 including a second meltable alloy sleeve 719. The method 600 can be utilized to seal the annulus 708 at the first desired seal location 713 and to seal the annulus 708 at the second desired seal location 713. Accordingly, the section of the annulus 708 between the first desired seal location 713 and the second desired seal location 713 can be isolated from the remainder of the annulus 708.

Scaling the annulus 708 at a desired seal location 713 and/or isolating a section of the annulus 708 may be desirable when there is a location where water is entering the annulus 708. According to one non-limiting example, water may be entering the annulus 708 at a certain location below a desired seal location 713. Accordingly, method 600 can be conducted above the area of water encroachment thus preventing the water from entering the inner bore 707 and being produced via a perforated tubular above the desired seal location 713 (as best illustrated in FIG. 5). Similarly, if a perforated tubular is located below the area of water encroachment, another desired seal location 713 including a meltable alloy sleeve 719 below the area of water encroachment can be utilized to seal the annulus 708 below the area of water encroachment. Similarly, a meltable alloy sleeve 719 above and a meltable alloy sleeve 719 below the area of water encroachment can be utilized to seal and isolate the section of the annulus 708 experiencing water encroachment.

Figure 7D:
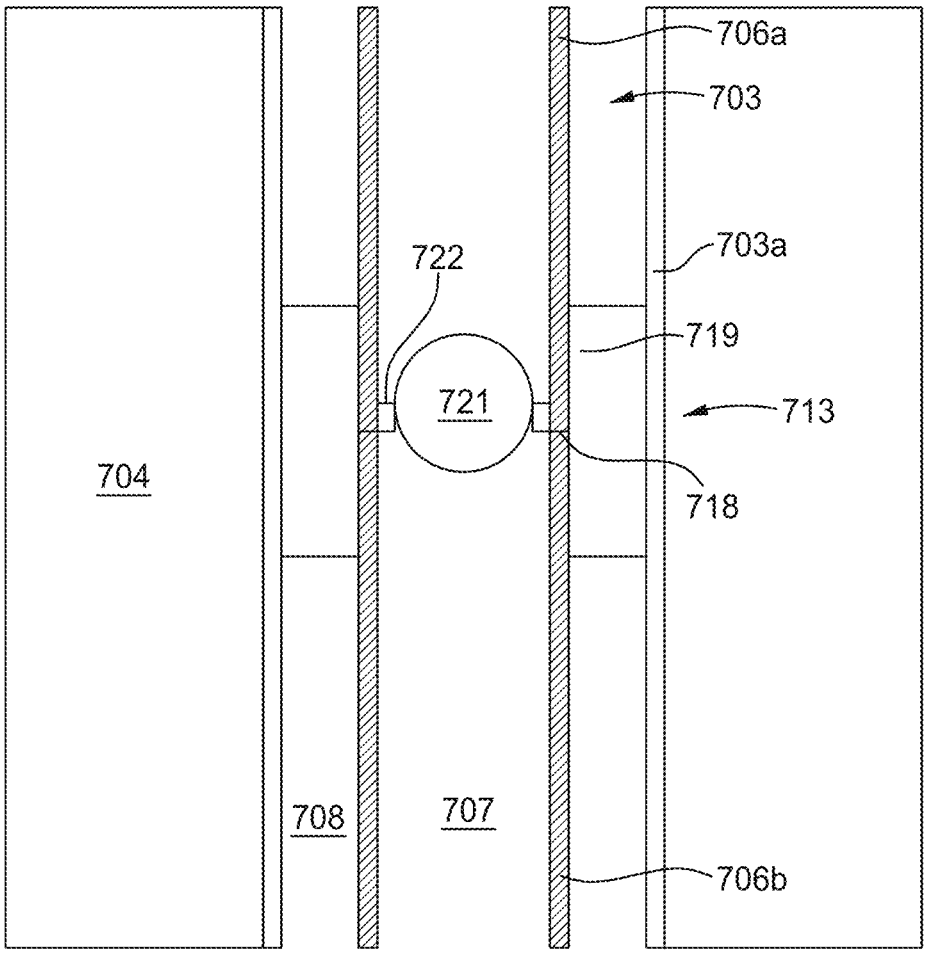

In one or more embodiments, after the annulus 708 is sealed at operation 604, the inner bore 707 may also be sealed. The inner bore 707 may be sealed for a variety of reasons, one of which being to seal off an entire portion of the wellbore 703 below desired seal location 713. As a non-limiting example, a portion of the wellbore 703 may be sealed to cease production in that portion (e.g., temporary or permanent well abandonment). As another non-limiting example, the inner bore 707 may be sealed below the desired seal location 713 for pinpoint fluid placement. As another non-limiting example, the inner bore 707 may be sealed below the desired seal location 713 selective production of sections of the wellbore 703. In one or more embodiments, and as shown in FIG. 7D, sealing the inner bore 707 includes dropping a sealing device 721 such as a ball or bridge plug or utilizing a mechanical seal such as a packer to seal the inner bore 707. In one or more embodiments, the sealing device 721 is caught on a catching feature 722 internal to the joint coupling 718 and/or one or more of the tubulars 706*a*, 706*b*. In one or more embodiments, such as the illustrated embodiment, the sealing device 721 is a ball or bridge plug. In one or more embodiments, such as the illustrated embodiment, the catching feature 722 is a shoulder internal to the tubular string 706. According to one mode of operation, the sealing device 721 is installed into the catching feature 722 thus sealing off the inner bore 707 below the catching feature 722.

Figure 8:
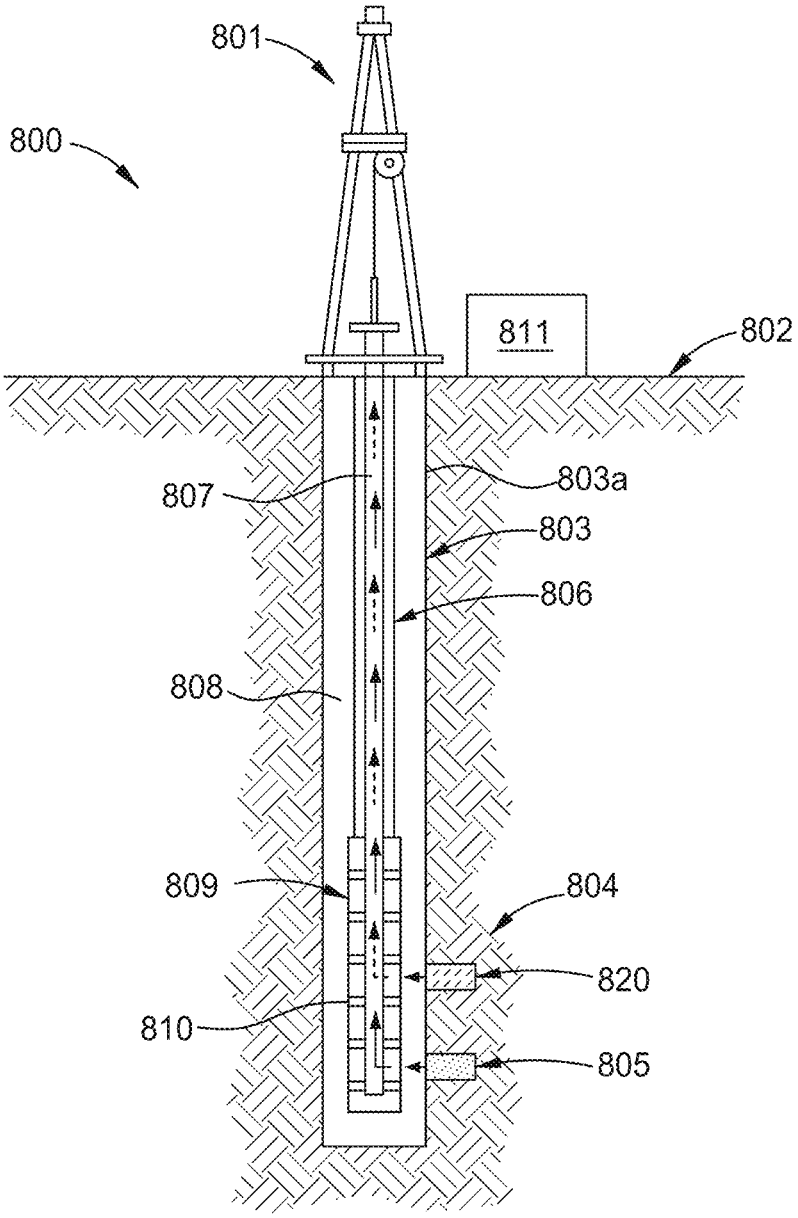
FIG. 8 illustrates a schematic view of another wellsite, according to one or more embodiments.

FIG. 8 illustrates a schematic view of another wellsite 800, according to one or more embodiments. Wellsites 100, 500, and 800 may be at least partially similar in components and operation. Accordingly, a description of like components and operations may not be repeated herein. Like reference numbers of similar components have been given the same last two digits.

The wellsite 800 includes the same components as wellsite 100. However, as illustrated in wellsite 800, and as described with reference to wellsite 500, occasionally water 820 is undesirably produced at the wellsite 800. Water 820 may flow into the annulus 808 and, thus, may be produced similar to how the reservoir fluids 805 are produced (i.e., flowed into the annulus 808, into a perforated tubular 809 through perforations 810, into the inner bore 807, and to the surface 802). In some embodiments, the water 820 flows from the geological formation 804 or some other underground aquifer. Water production 820 may create hydrostatic pressure in production tubing, which subjects hydrocarbon producing zones to an unhealthy back pressure. Unhealthy backpressure may prevent reservoir fluids from being produced.

Figure 9:
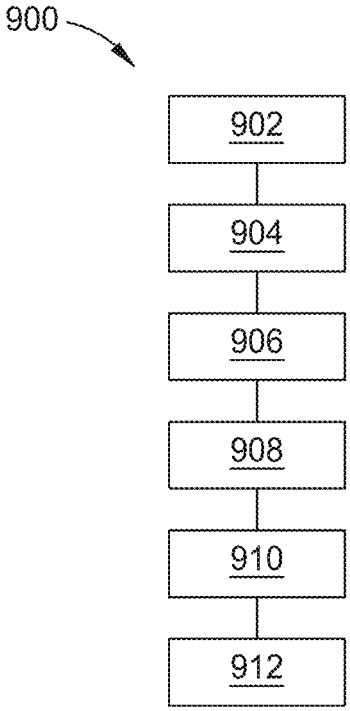
FIG. 9 illustrates a method for sealing a portion of a wellbore, according to one or more embodiments.

FIG. 9 illustrates a method 900 for sealing a portion of a wellbore. As a non-limiting example, the method 900 may be used when it is desirable to seal a portion of the wellbore (such as when there is undesirable water production). FIGS. 10A-10H schematically illustrate the method 900 of FIG. 9. Method 900 may be at least partially similar in components and operation to methods 200 and 600. Accordingly, a description of like components and operations may not be repeated herein. Like reference numbers of similar components have been given the same last two digits.

Figure 10A:
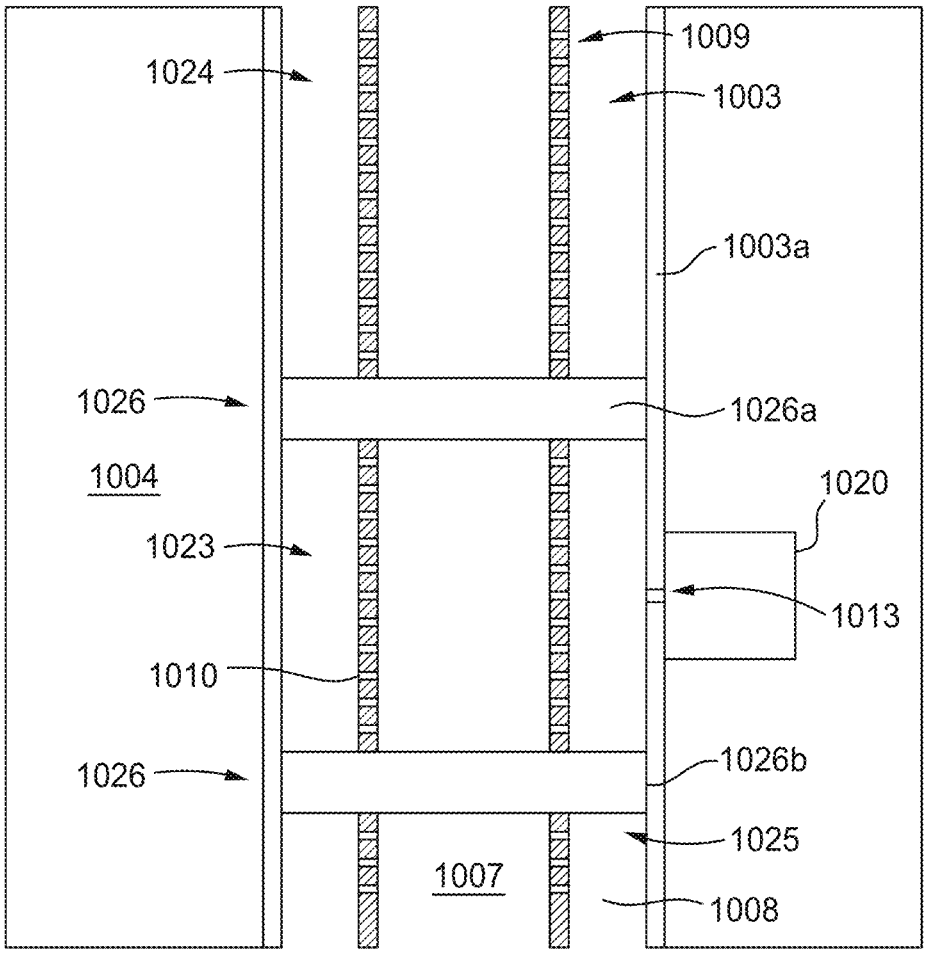
FIGS. 10A-10H schematically illustrate sealing a portion of a wellbore according to the method of FIG. 9, according to one or more embodiments.

At operation 902, and as illustrated in FIG. 10A, a section 1023 of the wellbore 1003 is isolated (isolated section 1023) from a remainder of the wellbore 1003 (second section 1024 and third section 1025). That is, the isolated section 1023 is fluidly isolated (i.e., fluid communication is prevented) from the remainder of the wellbore 1003. The isolated section 1023 may be isolated using one or more isolation bodies 1026. The one or more isolation bodies 1026 may include a first isolation body 1026*a* disposed above the desired seal location 1013 (e.g., the area where water 1020 is flowing into the annulus 1008) and a second isolation body 1026*b* disposed below the desired seal location 1013. In one or more embodiments, the isolation bodies 1026 completely isolate the isolated section 1023 of the wellbore 1003. That is, in one or more embodiments, the isolation bodies 1026 seal the entire cross-section of the wellbore 1003 including the inner bore 1007 of the perforated tubular 1009 and the annulus 1008. While presently illustrated as being a perforated portion of the perforated tubular 1009, it is contemplated that method 900 is similarly applicable to a non-perforated section of a tubular string (such as tubular string 806 of FIG. 8). In one or more embodiments, the isolation bodies 1026 are installed using methods 200 or 600 or some variation thereof.

Figure 10B:
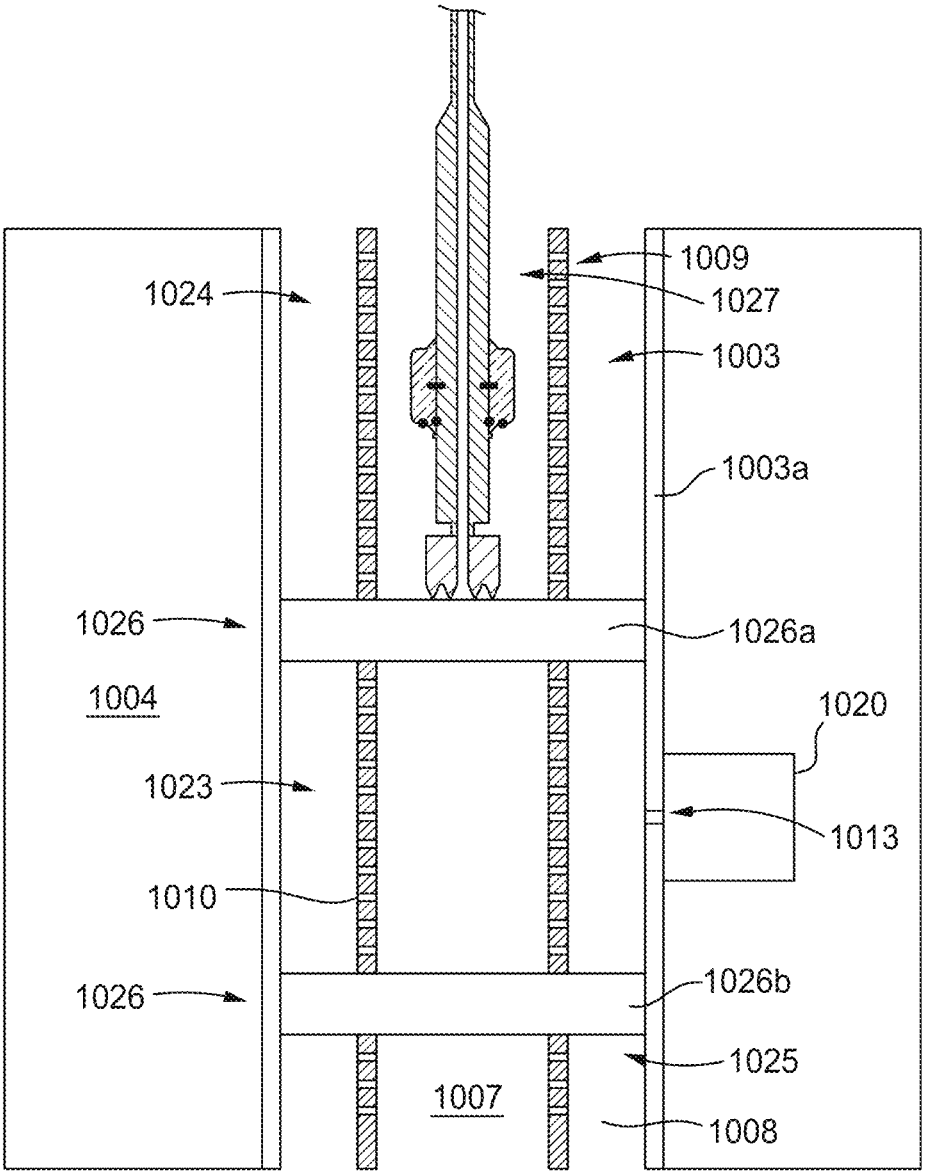
Figure 10C:
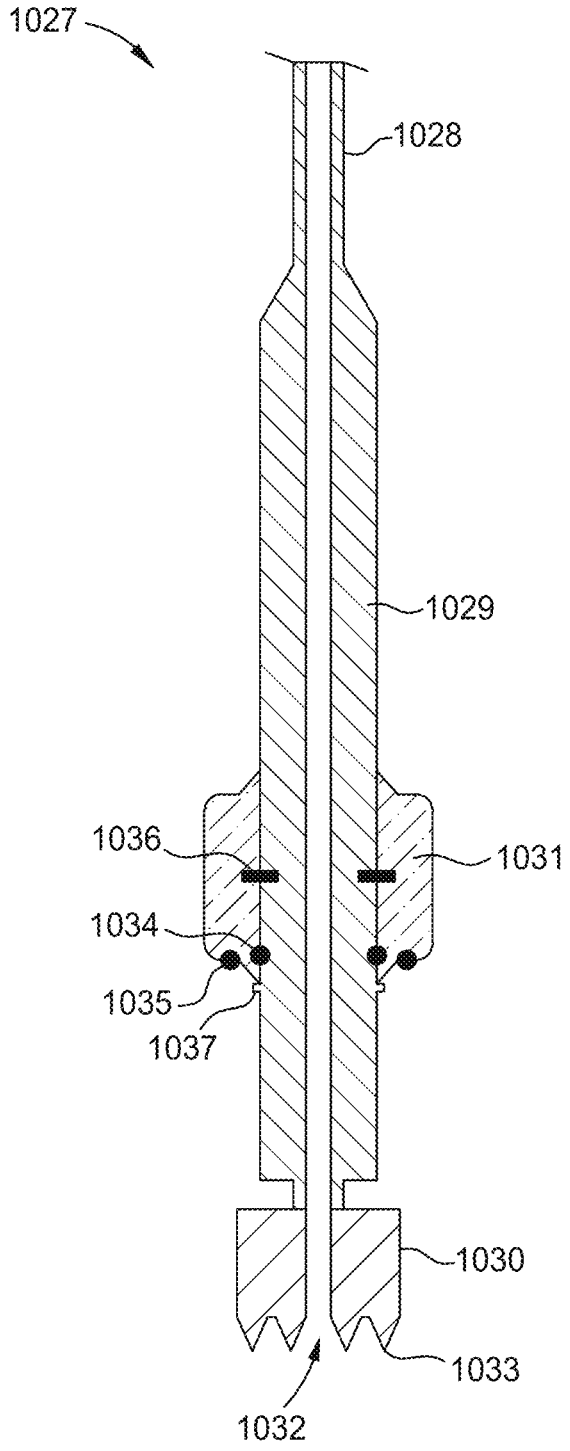

At operation 904, and as illustrated in FIG. 10B, a bottom hole assembly (BHA) 1027 is lowered through the inner bore 1007 of the perforated tubular 1009. In one or more embodiments, the BHA 1027 is lowered by coiled tubing 1028. In one or more embodiments, the BHA 1027 is lowered by a wireline. FIG. 10C is a schematic view of the BHA 1027.

The BHA 1027 includes a chassis 1029, a milling bit 1030, a sealing body 1031, and a bore 1032 through the entirety of the BHA 1027. The milling bit 1030 is rotatably coupled to a distal end of the chassis 1029 such that the milling bit 1030 is rotatable with respect to the chassis 1029. The milling bit 1030 includes cutting elements 1033 (e.g., teeth). The milling bit 1030 may be coupled to a motor (not shown) disposed within the BHA 1027 or attached to the BHA 1027 and configured to rotate the milling bit 1030 to cause the cutting elements 1033 to mill obstructions. In one or more embodiments, the BHA 1027 includes a power supply and a processing system to operate the various functions of the BHA 1027. In one or more embodiments, the BHA 1027 is coupled to a processing system and/or power supply at the surface (such as processing systems 111, 511, 811).

The sealing body 1031 is disposed about the chassis 1029. In one or more embodiments, the sealing body 1031 is a wedge seal. In one or more embodiments, one or more seals 1034 are disposed between the sealing body 1031 and the chassis 1029. In one or more embodiments, the sealing body 1031 includes one or more seals 1035 disposed about the sealing body 1031. The sealing body 1031 is releasably coupled to the chassis 1029. That is, the scaling body 1031 is slideable relative to the chassis 1029 but is releasably held in place. For example, in one or more embodiments, the sealing body 1031 is releasably coupled to the chassis 1029 by shear pins 1036. The shear pins 1036 retain the sealing body 1031 in place until a force is applied to the sealing body 1031 sufficient to shear the shear pins 1036. When the shear pins 1036 are sheared, the sealing body 1031 is able to slide with respect to the chassis 1029. In one or more embodiments, the chassis 1029 includes a shoulder 1037 extending from an outer surface of the chassis 1029 downhole of the sealing body 1031 preventing the scaling body 1031 from sliding downhole with respect to the chassis 1029.

The bore 1032 is fluidly coupled to a fluid supply (not shown). In one or more embodiments, the fluid supply is coupled to (or integral to) the BHA 1027. In one or more embodiments, the fluid supply is located at the surface (such as surface 802) and is coupled to the bore 1032 by, for instance, the coiled tubing 1028 or other tubulars and/or lines. The bore 1032 extends through the chassis 1029 and extends through the milling bit 1030 such that the fluid from the fluid supply can flow through the BHA 1027, and downhole of the BHA 1027.

Figure 10D:
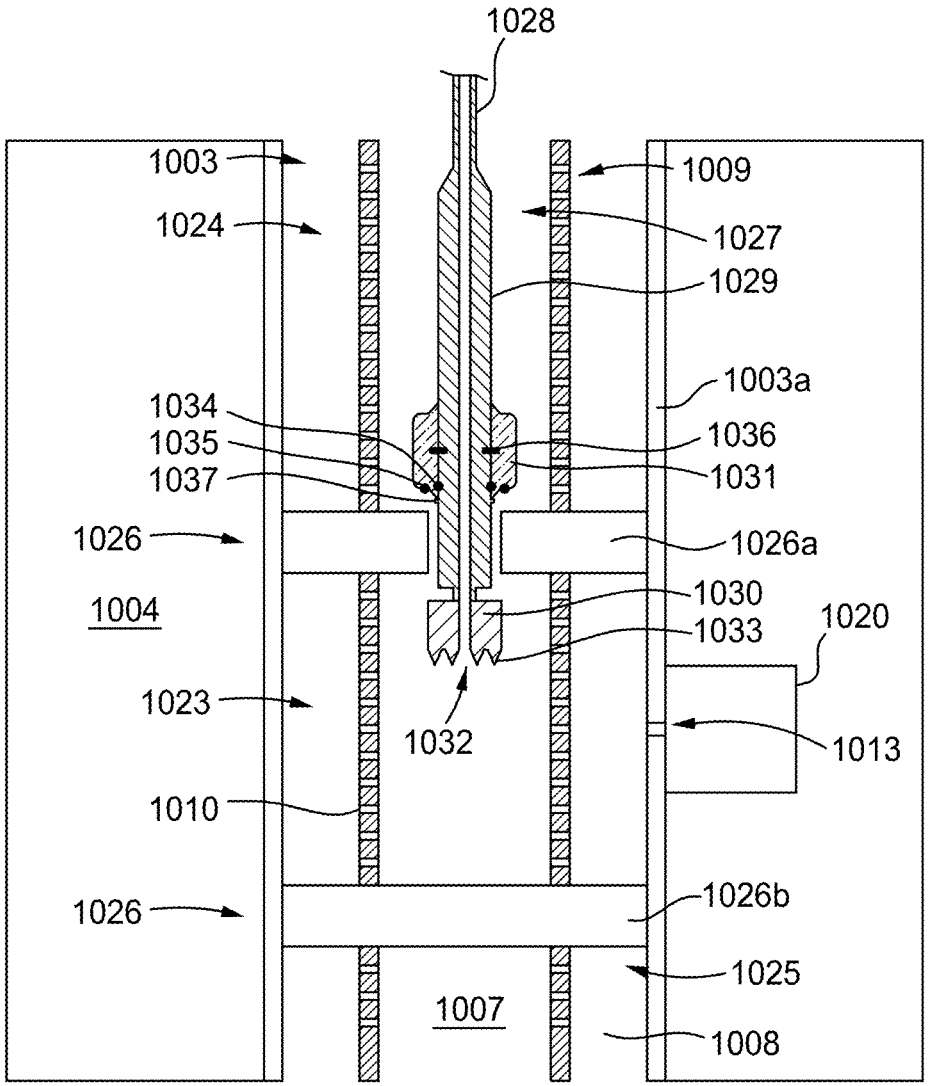

At operation 906, and as shown in FIG. 10D, the milling bit 1030 of the BHA 1027 mills a portion of the first isolation body 1026*a* within the bore 1007 of the perforated tubular 1009. When the milling bit 1030 mills the first isolation body 1026*a*, a portion of the BHA 1027 (e.g., the portion including the milling bit 1030) is disposed within the isolated section 1023 of the wellbore 1003. Similarly, when the milling bit 1030 mills the first isolation body 1026*a*, the bore 1032 extending through the BHA 1027 is in fluid communication with the isolated section 1023 of the wellbore 1003. In one or more embodiments, the milled portion is of a diameter that allows the milling bit 1030 and the chassis 1029 to pass through the first isolation body 1026*a* but prevents the sealing body 1031 from passing through the milled portion of the first isolation body 1026*a*.

Figure 10E:
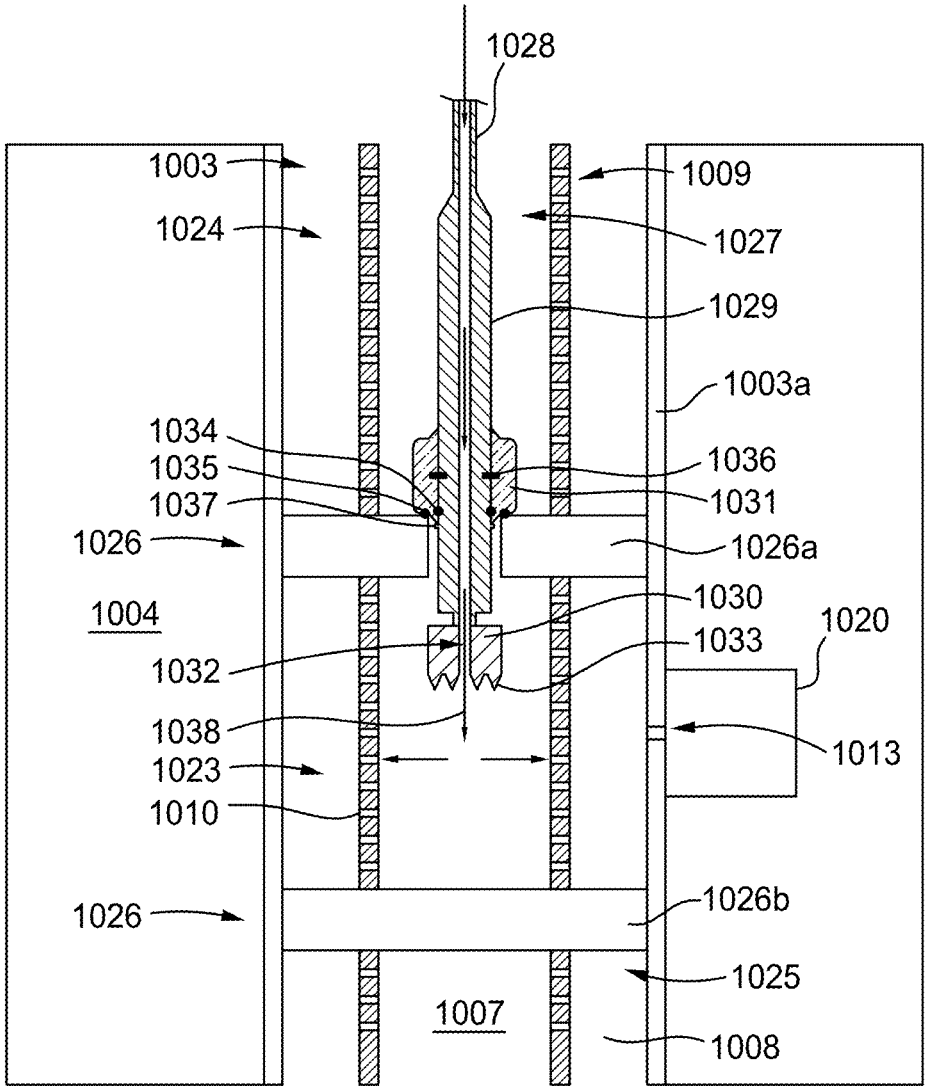

At operation 908, and as shown in FIG. 10E, the sealing body 1031 seals against the milled portion of the first isolation body 1026*a*. In one or more embodiments, as the BHA 1027 is lowered further into the bore 1007 of the perforated tubular 1009 past the first isolation body 1026*a*, the scaling body 1031 contacts the milled portion of the first isolation body 1026*a* and seals against the milled portion of the first isolation body 1026*a*. In embodiments including seals 1035 disposed about the sealing body 1031, the seals 1035 provide a seal between the scaling body 1031 and the milled portion of the first isolation body 1026*a*. Further, in embodiments including the seals 1034 disposed between the scaling body 1031 and the chassis 1029, the seals 1034 provide a seal between the scaling body 1031 and the chassis 1029. Accordingly, the isolated section 1023 of the wellbore 1003 is again isolated from the remainder of the wellbore 1003 (e.g., sections 1024 and 1025) while providing fluid communication to the isolated section 1023 via the bore 1032 of the BHA 1027.

At operation 910, and also shown in FIG. 10E, a scaling agent 1038 is flowed through the bore 1032 of the BHA 1027 into the isolated section 1023 of the wellbore 1003. In one or more embodiments, the scaling agent 1038 includes stimulation fluid, chemical scaling agents, cement, resin, or any other sealing agent flowable into the annulus to seal the annulus (and/or a part of the formation). The sealing agent 1038 flows through the chassis 1029, through the milling bit 1030, into the bore 1007 of the perforated tubular 1009, and into the annulus 1008 of the isolated section 1023 of the wellbore 1003 through the perforations 1010. The scaling agent 1038 is configured to flow into the annulus 1008 and seal the desired seal location 1013 thus preventing flow into the annulus 1008 and into the perforated tubular 1009 in the isolated section. In one or more embodiments, the scaling agent 1038 flows into and seals the entirety of the annulus 1008 of the isolated section 1023. In one or more embodiments, the sealing agent 1038 also flows into the formation 1004 to seal a portion of the formation 1004. In one or more embodiments, the scaling agent 1038 has to be cured (e.g., by native formation temperature or applying heat) to form a seal. Accordingly, a heater (not shown) integral to, or separate from the BHA 1027 may be used to cure the sealing agent 1038. In one or more embodiments, the sealing agent 1038 may be selectively cured using heating gradients similar to how has been described with respect to methods 200 and 600. In one or more embodiments, static temperature of the wellbore 1003 is used to cure the scaling agent 1038. That is, the chemical properties of the sealing agent 1038 have been designed such that the static temperature of the wellbore cures the sealing agent 1038.

In one or more embodiments where the method 900 is being conducted on a non-perforated tubular (not shown), the non-perforated tubular is perforated before operation 910 so that the sealing agent 1038 can flow to the annulus 1008 from perforated tubular.

Figure 10F:
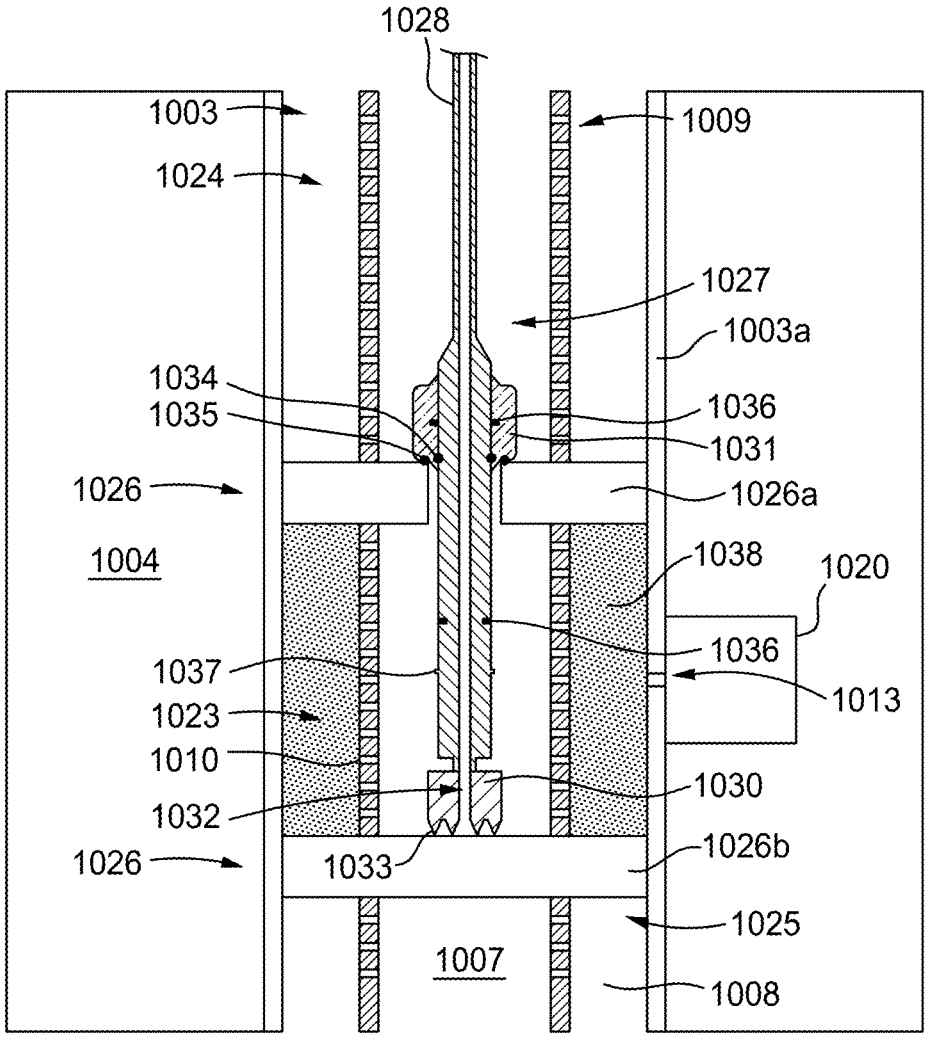
Figure 10G:
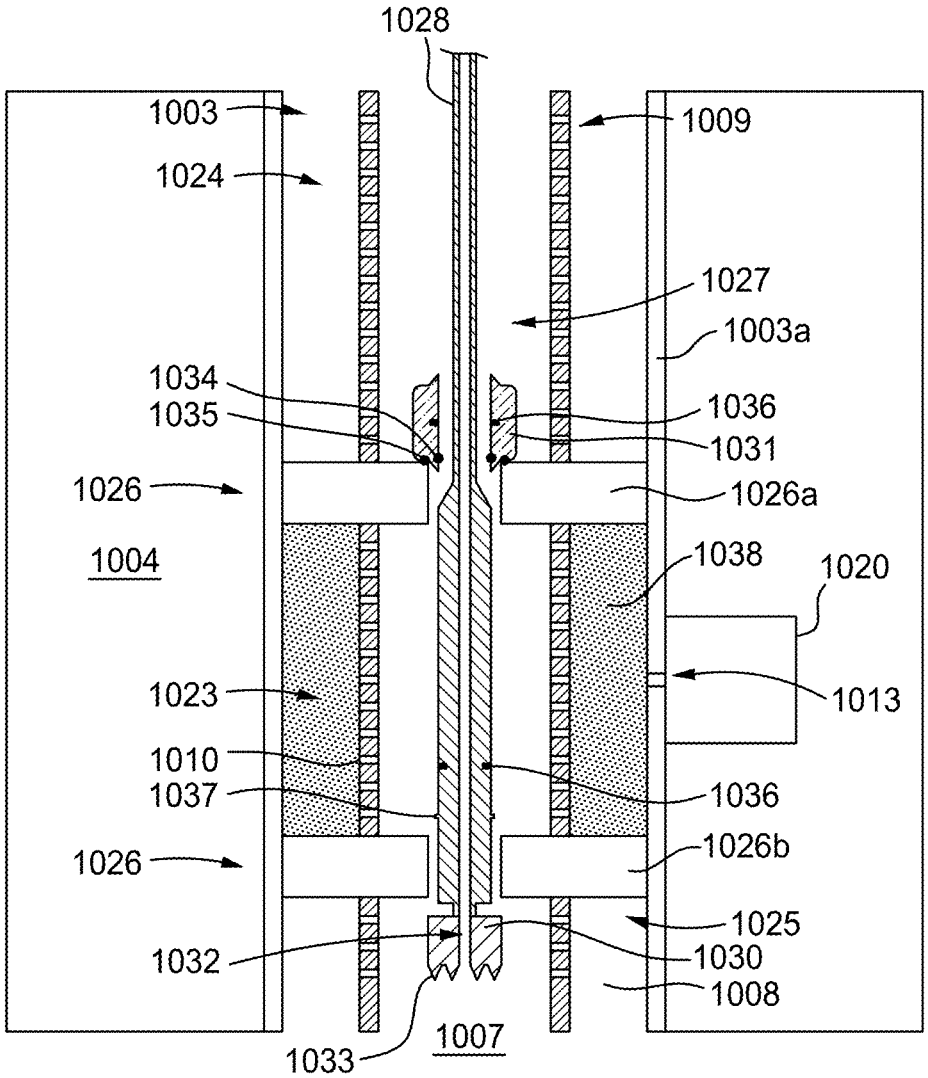

At operation 912, as illustrated in FIGS. 10F-10G, the BHA 1027 is lowered through the bore 1007 within the isolated section 1023 and mills a portion of the second isolation body 1026*b*. As the BHA 1027 is lowered toward the second isolation body 1026, the shear pins 1036 are sheared thus allowing the chassis 1029 to move with respect to the sealing body 1031 leaving the sealing body 1031 engaged with the milled portion of the first isolation body 1026*a*.

In one or more embodiments, the sealing agent 1038 of operation 910 may fill and solidify a portion of the bore 1007 within the isolated section 1023 below the BHA 1027. In such embodiments, operation 912 may also include milling the sealing agent 1038 within the bore 1007 above the second isolation body 1026*b*.

As the BHA 1027 is lowered and mills a portion of the second isolation body 1026*b*, fluid communication between the isolated section 1023 of the bore 1007 and the remainder of the bore 1007 (e.g., sections 1024 and 1025) is restored. That is, the bore 1007 within the isolated section 1023 is no longer isolated allowing flow throughout the entirety of the bore 1007. While fluid communication between the isolated section 1023 of the bore 1007 and the remainder of the bore 1007 is restored, fluid communication from the annulus 1008 within the isolated section 1023 to the bore 1007 of the tubular string 1009 is still prevented.

Figure 10H:
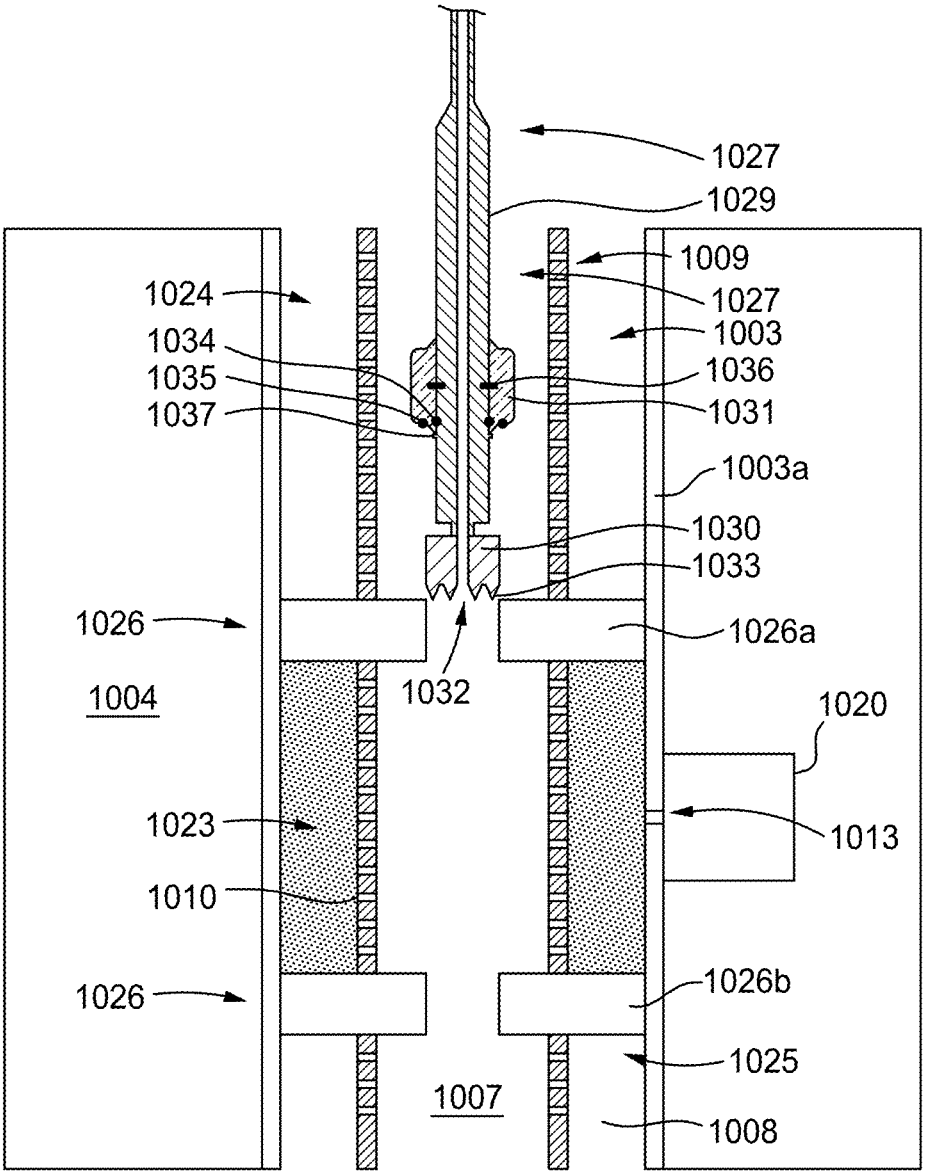

After a portion of the second isolation body 1026*b* is milled, the BHA 1027 may be retrieved from the wellbore 1003, as illustrated in FIG. 10H. Retrieving the BHA 1027 from the wellbore 1003 may include raising the BHA 1027 uphole within the bore 1007 of the perforated tubular 1009. As the BHA 1027 is raised, the sealing body 1031 is also retrieved. In one or more embodiments, the shoulder 1037 of the BHA 1027 engages with a portion of the sealing body 1031 to guide the sealing body 1031 uphole with the remainder of the BHA 1027. With the BHA 1027 removed from the wellbore 1003, the wellbore 1003 may operate by producing fluids (e.g. reservoir fluids) through the bore 1007 of the perforated tubular 1009 while the desired seal location 1013 and corresponding section of the annulus 1008 is sealed by the sealing agent 1038. Accordingly, method 900 may be accomplished in one run of the BHA 1027 thus minimizing downtime and simplifying isolation and sealing processes.

Any one or more components of the illustrated embodiments may be integrally formed together, directly coupled together, and/or indirectly coupled together and are not limited to the specific arrangement of components illustrated in FIGS. 1-10H. Any one or more of the embodiments of the described embodiments and methods may be combined in whole or part with any one or more of the embodiments of the described embodiments and methods.

Example Aspects

Aspect 1: a method and system for sealing a perforated tubular. The method includes disposing a meltable alloy in a wellbore including a perforated tubular disposed therein at a desired seal location, the wellbore and the perforated tubular defining an annulus and applying a heating gradient to the meltable alloy such that the meltable alloy melts and resolidifies before the meltable alloy seals an entire cross-section of the annulus.

Aspect 2: The method of Aspect 1, wherein the meltable alloy comprises Bismuth.

Aspect 3: The method of any of Aspects 1 or 2, wherein applying the heating gradient to the meltable alloy includes lowering a heater into the perforated tubular and applying the heating gradient via the heater.

Aspect 4: The method of Aspect 3, wherein the heating gradient varies by radial distance from the heater.

Aspect 5, the method of any of Aspects 3 or 4, wherein disposing the meltable alloy in the wellbore includes providing a sleeve of the meltable alloy on the heater, and disposing the meltable alloy in the wellbore includes lowering the heater including the sleeve to the desired seal location within the perforated tubular.

Aspect 6, the method of any of Aspects 3 or 4, wherein disposing the meltable alloy in the wellbore at a desired seal location includes pumping pellets of the meltable alloy through an annulus created between the perforated tubular and the heater to the desired seal location.

Aspect 7: a method of sealing an annulus of a wellbore. The method includes lowering a heater into a tubular to a desired isolation location, the tubular is disposed within a wellbore defining an annulus therebetween and includes a meltable alloy sleeve disposed about the tubular at the desired isolation location and applying a heat gradient to the meltable alloy sleeve such that the meltable alloy sleeve melts to fill the annulus at the desired isolation location and resolidifies to seal the annulus at the desired isolation location.

Aspect 8: The method of Aspect 7, wherein the tubular is a tubular string including a first tubular joined in series to a second tubular by a joint and the joint includes the meltable alloy sleeve.

Aspect 9: The method of Aspect 8, wherein the meltable alloy sleeve is disposed about the joint coupling the first tubular to the second tubular.

Aspect 10: The method of any of Aspects 7-9, further comprising deploying a sealing device within the tubular to the desired isolation location to seal an inner bore of the tubular at the desired isolation location to isolate a portion of the inner bore below the desired isolation location.

Aspect 11: a method of sealing a portion of a wellbore. The method includes isolating a section of a wellbore from a remainder of the wellbore using a first isolation body disposed above the section of the wellbore and a second isolation body disposed below the section of the wellbore, wherein a perforated tubular is disposed within the wellbore defining an annulus between the perforated tubular and the wellbore, lowering a bottom hole assembly (BHA) through a bore of the perforated tubular, milling a portion of the first isolation body within the bore of the perforated tubular with the BHA, sealing a portion of the BHA against the milled portion of the first isolation body, flowing a sealant from the BHA into the annulus of the isolated section of the wellbore to seal the annulus, and milling a portion of the second isolation body within the bore of the perforated tubular with the BHA.

Aspect 12: The method of Aspect 11, wherein sealing a portion of the BHA against the milled portion of the first isolation body includes engaging a sealing body of the BHA with the milled portion of the first isolation body.

Aspect 13: The method of Aspect 12, wherein while the BHA is lowered through the bore of the perforated tubular, the sealing body is releasably coupled to a chassis of the BHA by a shear pin.

Aspect 14: The method of Aspect 13, wherein the sealing body includes a seal between the sealing body and the chassis of the BHA.

Aspect 15: The method of any of Aspects 13 or 14, wherein after the sealant is flowed into the annulus of the isolated section, the shear pin is sheared such that the chassis of the BHA is lowered past the sealing body to mill the portion of the second isolation body.

Aspect 16: The method of Aspect 15, wherein after the portion of the second isolation body is milled, the chassis of the BHA is raised through the bore of the perforated tubular and engages with the sealing body to raise the sealing body and the chassis of the BHA to a surface.

Aspect 17: The method of any of Aspects 12-16, wherein the sealing body is a wedge scal.

Aspect 18: The method of any of Aspects 11-17, wherein the sealant prevents flow into the annulus from a formation through which the wellbore is disposed.

Aspect 19: The method of any of Aspects 11-18, wherein the first isolation body and the second isolation body are milled with a milling bit disposed at a distal end of the BHA.

Aspect 20: The method of Aspect 19, wherein the sealant is flowed into the isolated section of the wellbore through the milling bit.

The methods disclosed herein comprise one or more actions for achieving the methods. The method actions may be interchanged with one another without departing from the scope of the claims. In other words, unless a specific order of actions is specified, the order and/or use of specific actions may be modified without departing from the scope of the claims. Further, the various operations of methods described above may be performed by any suitable means capable of performing the corresponding functions.

While the present disclosure has been described with respect to a number of embodiments and examples, those skilled in the art, having benefit of this disclosure, will appreciate that other embodiments can be devised which do not depart from the scope and spirit of the present disclosure.

The preceding description, for purposes of explanation, uses specific nomenclature to provide a thorough understanding of the disclosure and is provided to enable any person skilled in the art to practice the various aspects described herein. However, it will be apparent to one skilled in the art, which the specific details are not required in order to practice the systems and methods described herein. The examples discussed herein are not limiting of the scope, applicability, or aspects set forth in the claims. They are not intended to be exhaustive of or to limit this disclosure to the precise forms described. Various modifications to these aspects will be readily apparent to those skilled in the art, and the general principles defined herein may be applied to other aspects. For example, changes may be made in the function and arrangement of elements discussed without departing from the scope of the disclosure. Various examples may omit, substitute, or add various procedures or components as appropriate. The examples are shown and described in order to best explain the principles of this disclosure and practical applications, to thereby enable others skilled in the art to best utilize this disclosure and various examples with various modifications as are suited to the particular use contemplated. For instance, the methods described may be performed in an order different from that described, and various actions may be added, omitted, or combined. Also, features described with respect to some examples may be combined in some other examples. For example, an apparatus may be implemented or a method may be practiced using any number of the aspects set forth herein. In addition, the scope of the disclosure is intended to cover such an apparatus or method that is practiced using other structure, functionality, or structure and functionality in addition to, or other than, the various aspects of the disclosure set forth herein. It should be understood that any aspect of the disclosure disclosed herein may be embodied by one or more elements of a claim. It is intended which the scope of this disclosure be defined by the claims and their equivalents below.

What is claimed is:

1. A method of sealing a portion of a wellbore, comprising:

isolating a section of a wellbore from a remainder of the wellbore using a first isolation body disposed above the section of the wellbore and a second isolation body disposed below the section of the wellbore, wherein a perforated tubular is disposed within the wellbore defining an annulus between the perforated tubular and the wellbore;

lowering a bottom hole assembly (BHA) through a bore of the perforated tubular;

milling a portion of the first isolation body within the bore of the perforated tubular with the BHA;

sealing a portion of the BHA against the milled portion of the first isolation body;

flowing a sealant from the BHA into the annulus of the isolated section of the wellbore to seal the annulus of the isolated section of the wellbore; and milling a portion of the second isolation body within the bore of the perforated tubular with the BHA.

2. The method of claim 1, wherein sealing a portion of the BHA against the milled portion of the first isolation body includes engaging a sealing body of the BHA with the milled portion of the first isolation body.

3. The method of claim 2, wherein while the BHA is lowered through the bore of the perforated tubular, the sealing body is releasably coupled to a chassis of the BHA by a shear pin.

4. The method of claim 3, wherein the sealing body includes a seal between the sealing body and the chassis of the BHA.

5. The method of claim 3, wherein after the sealant is flowed into the annulus of the isolated section, the shear pin is sheared such that the chassis of the BHA is lowered past the sealing body to mill the portion of the second isolation body.

6. The method of claim 5, wherein after the portion of the second isolation body is milled, the chassis of the BHA is raised through the bore of the perforated tubular and engages with the sealing body to raise the sealing body and the chassis of the BHA to a surface.

7. The method of claim 2, wherein the sealing body is a wedge seal.

8. The method of claim 1, wherein the sealant prevents flow into the annulus from a formation through which the wellbore is disposed.

9. The method of claim 1, wherein the first isolation body and the second isolation body are milled with a milling bit disposed at a distal end of the BHA.

10. The method of claim 9, wherein the sealant is flowed into the isolated section of the wellbore through the milling bit.

* * * * *